US008769774B2

(12) United States Patent
Aveni

(10) Patent No.: US 8,769,774 B2
(45) Date of Patent: Jul. 8, 2014

(54) BELT AND/OR BUCKLE ASSEMBLY

(75) Inventor: Michael A. Aveni, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 13/426,265

(22) Filed: Mar. 21, 2012

(65) Prior Publication Data

US 2012/0174438 A1 Jul. 12, 2012

Related U.S. Application Data

(63) Continuation of application No. 12/207,227, filed on Sep. 9, 2008, now Pat. No. 8,156,614.

(51) Int. Cl.
*A44B 11/24* (2006.01)

(52) U.S. Cl.
USPC ..... 24/68 E; 24/178; 24/188; 24/197; 24/68 SK; 36/50.1

(58) Field of Classification Search
USPC ..... 24/176–178, 180, 186, 188; 2/338
See application file for complete search history.

(56) References Cited

U.S. PATENT DOCUMENTS

| | | | | | |
|---|---|---|---|---|---|
| RE8,655 | E | * | 4/1879 | Hersome | 24/188 |
| 317,360 | A | * | 5/1885 | Hopkins | 36/7.3 |
| 599,626 | A | * | 2/1898 | Nelson | 24/179 |
| 666,320 | A | * | 1/1901 | Klinger | 24/593.11 |
| 707,032 | A | * | 8/1902 | Spiering | 24/369 |
| 750,834 | A | * | 2/1904 | Engels | 24/598.1 |
| 847,064 | A | * | 3/1907 | Griffin | 24/176 |
| 849,516 | A | * | 4/1907 | Van Cleve | 24/265 BC |
| 857,999 | A | * | 6/1907 | Hayes | 36/50.1 |
| 1,088,408 | A | * | 2/1914 | Eichberg | 24/198 |
| 1,523,041 | A | * | 1/1925 | Simmons | 24/320 |
| 1,795,559 | A | * | 3/1931 | Hellmann | 29/3 |
| 1,882,369 | A | * | 10/1932 | Russell | 24/188 |
| 2,069,381 | A | * | 2/1937 | Morgan | 36/54 |
| 2,071,593 | A | * | 2/1937 | Thormann | 36/50.5 |
| 2,101,586 | A | * | 12/1937 | Leach | 40/304 |
| 2,341,608 | A | * | 2/1944 | Gey | 24/16 PB |
| 2,466,742 | A | * | 4/1949 | Roehrl | 24/578.15 |
| 2,481,179 | A | * | 9/1949 | Turini | 29/3 |
| 2,619,697 | A | * | 12/1952 | Legat | 24/178 |
| 2,897,566 | A | * | 8/1959 | Albiniano | 24/188 |
| 2,936,980 | A | * | 5/1960 | Rapata | 24/16 PB |
| 3,318,354 | A | * | 5/1967 | Borisof | 206/38.1 |
| 3,357,067 | A | * | 12/1967 | Baues | 24/176 |
| 3,837,101 | A | * | 9/1974 | Young | 40/665 |
| 4,077,562 | A | * | 3/1978 | Ballin | 383/71 |
| 4,373,236 | A | * | 2/1983 | Fera | 29/3 |

(Continued)

*Primary Examiner* — Jack W. Lavinder
(74) *Attorney, Agent, or Firm* — Banner & Witcoff, Ltd.

(57) ABSTRACT

Buckle type attachment elements, such as for belts, watch bands, or the like, and/or for securing or fastening elements (e.g., for footwear, handbags, briefcases, containers, or other objects) may be produced in a manner that generates minimal waste materials, without the use of metal or mechanical hardware type connectors, from completely recyclable materials, without the need for molding, without the use of plastics, and/or without the use of adhesives or cements. Such buckle elements may include a buckle portion and a tongue portion formed from the same material. In some structures, the tongue portion may be made from a part cut out to form the buckle portion. In other structures, the tongue portion may be formed by cutting slits into a base substrate that also makes up the buckle portion. Final products and methods of making such products also are described.

10 Claims, 14 Drawing Sheets

(56) References Cited

U.S. PATENT DOCUMENTS 4,510,649 A * 4/1985 Yudis et al. ..... 24/16 PB
4,747,165 A * 5/1988 Limbach ..... 2/322
4,815,222 A * 3/1989 Eisenbach et al. ..... 36/131
5,974,698 A * 11/1999 Nash et al. ..... 36/87
7,441,946 B2 * 10/2008 Bonadei ..... 368/282
8,156,614 B2 * 4/2012 Aveni ..... 24/176
2010/0058562 A1 * 3/2010 Aveni ..... 24/190

* cited by examiner

BELT AND/OR BUCKLE ASSEMBLY

This application is a continuation of application Ser. No. 12/207,227, filed Sep. 9, 2009, which is incorporated herein by reference in its entirety.

FIELD OF THE INVENTION

This invention relates generally to buckle type attachment elements, such as for belts, watch bands, or the like, and/or for securing or fastening elements (e.g., for footwear, handbags, briefcases, backpacks, purses, containers, or other objects), and products including such attachment elements.

BACKGROUND

The use of belts and/or buckles in footwear, particularly athletic footwear, has been limited due to issues with their weight, dimensions (bulk), expense, and lack of comfort. Often heavy and anything but low profile, buckles typically are considered more cosmetic in footwear than performance affecting. Also, traditional belts and/or buckles tend to create high pressure points when placed onto the instep portion of the shoe, which is in contact with the foot. These high pressure points caused by the buckle can cause discomfort and pain to the wearer. In addition, traditional buckles are made of metal and plastic or include metal or plastic parts. Due to this construction and material, the expense generally is considered too great to include belt and/or buckle assemblies in footwear. The great adjustability qualities associated with belt and/or buckle assemblies in footwear tend to end up being secondary to these issues.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to features of buckle type attachment elements, such as for belts, watch bands, or the like, and/or for securing or fastening elements (e.g., for footwear, handbags, briefcases, purses, containers, books, ledgers, or other objects). Buckle and/or belt assemblies in accordance with at least some examples of this invention may be designed to be produced with minimal waste materials, without the use of metal or mechanical hardware type connectors, and/or from completely recyclable materials. Additionally or alternatively, in accordance with at least some examples of this invention, the buckle and/or belt assemblies may be produced without the need for molding, without the use of plastics, and/or without the use of adhesives or cements. Such features can reduce the production costs of the products, improve their recyclability, and/or provide a more environmentally friendly product and/or production process.

Buckle-tongue assemblies in accordance with at least some examples of this invention may include: (a) a buckle piece that has an opening defined therethrough; and (b) a tongue piece engaged with the buckle piece, wherein the tongue piece is formed from a material cut out of the buckle piece to form the opening. If desired, the buckle piece may include a strap element extending from one of its edges and/or the buckle piece may include an integrally formed strap element (e.g., to form a complete belt type structure).

Buckle-tongue assemblies in accordance with other examples of this invention may be provided as a single piece, unitary construction. Such assemblies may include a base substrate having one or more slits defined therein, wherein the one or more slits separate the base substrate into a tongue portion and a buckle portion that remain integrally connected together. In some example structures according to this aspect of the invention, at least two conjoined slits separate the base substrate into the tongue portion and the buckle portion. Moreover, in some example structures according to this invention, three conjoined slits may be provided to separate the base substrate into the tongue portion and the buckle portion. As yet another example, a curved slit may be used to separate the base substrate into the tongue portion and the buckle portion. If desired, at least a portion of the tongue portion may be tapered or narrowed to provide its narrowest width nearest to its free end. If desired, the buckle portion may include a strap extending from one of its edges and/or the buckle portion may include an integrally formed strap element (e.g., to form a complete belt type structure).

Still additional buckle-tongue assemblies according to examples of this invention may include: (a) a base substrate having a base surface; (b) a buckle portion extending from the base substrate, wherein the buckle portion is formed from a strip of flexible material that has a first end, a second end opposite the first end, and a first major surface, and wherein the strip of flexible material extends from the base substrate such that: (i) the first major surface at the first end of the strip is engaged with the base surface, (ii) the first major surface at the second end of the strip is engaged with the base surface, (iii) at least one twist is formed in the strip between its first end and second end, and (iv) an opening is defined at least in part by the strip; and (c) a tongue portion extending from the base substrate and across the opening defined by the strip. The tongue portion may be separately attached to or integrally formed with the base substrate.

Additional example aspects of this invention relate to buckle-tongue assemblies that include: (a) a base substrate having a first major surface and a second major surface opposite the first major surface; (b) a buckle portion integrally formed with and extending from the base substrate, wherein the buckle portion includes a first strip of flexible material extending from a first edge of the base substrate and a second strip of flexible material extending from a second edge of the base substrate, wherein a free end of the first strip is engaged with the first major surface of the base substrate at the second edge, and wherein a free end of the second strip is engaged with the second major surface of the base substrate at the first edge; and (c) a tongue portion integrally formed with and extending from the base substrate at a location between the first and second strips. The first strip of flexible material may extend to the second edge of the base substrate such that a free end of the tongue portion extends to an edge of the first strip of flexible material, and the second strip of flexible material may extend to the first edge of the base substrate such that the free end of the tongue portion extends to an edge of the second strip of flexible material.

Additional aspects of this invention relate to methods for producing buckle-tongue assemblies, blanks therefor, and buckle-strap assemblies, as well as to methods of producing products that include such structures, such as belts, watch bands, closure systems, securing systems, etc.

BRIEF DESCRIPTION OF THE DRAWINGS

A more complete understanding of the present invention and certain advantages thereof may be acquired by referring to the following detailed description in consideration with the accompanying drawings, in which.

Figure 1A:
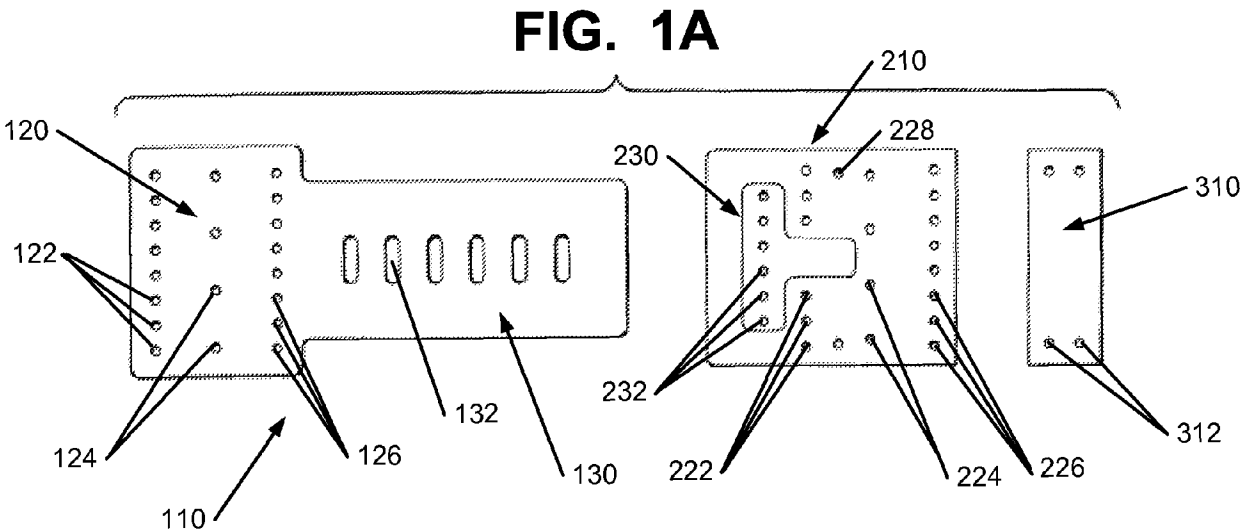
FIGS. 1A through 1I illustrate an example strap and buckle assembly according to this invention, its construction, and its use.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example buckle-tongue assemblies, buckle and strap assemblies, and products containing such assemblies in accordance with this invention. Additionally, it is to be understood that other specific arrangements of parts and structures may be utilized, and structural and functional modifications may be made to the parts and structures without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

In general, as described above, aspects of this invention relate to buckle-tongue assemblies, buckle and strap assemblies, and products containing such assemblies. Specific examples of the invention are described in more detail below. The reader should understand that these specific examples are set forth merely to illustrate examples of the invention, and they should not be construed as limiting the invention.

A. General Description of Aspects of This Invention

1. Buckle-Tongue Assemblies

As noted above, in general, aspects of this invention relate to features of buckle type attachment elements, e.g., for closure or securing systems. For example, buckle-tongue assemblies in accordance with examples of this invention may include: (a) a buckle piece that has an opening defined therethrough; and (b) a tongue piece engaged with the buckle piece, wherein the tongue piece is formed from a material cut out of the buckle piece to form the opening. If desired, the buckle piece may include a strap extending from one of its edges and/or the buckle piece may include an integrally formed strap element (e.g., to form a complete belt type structure). Buckle-tongue assemblies according to this invention further may include one or more loop elements engaged with the buckle piece (or provided on another element of the overall structure) to thereby define a slot for receiving the strap (e.g., to secure the free end of the strap member that extends through the opening of the buckle piece).

In some example structures according to this invention, the opening formed in the buckle piece and the exterior of the tongue piece may have the same perimeter shape, such as a T-shape. In such structures, the tongue piece may include a base portion (e.g., the horizontal cross-bar of the "T") and an extending portion (e.g., the vertical central member of the "T"), such that the base portion is wider than the extending portion. Similarly, the T-shaped opening in the buckle piece (from which the material for the tongue piece is obtained) includes a base opening portion (e.g., the horizontal cross-bar of the "T") and an extending opening portion (e.g., the vertical central member of the "T"), such that the base opening portion is wider than the extending opening portion. In the assembled buckle-tongue assembly, the tongue piece may be arranged such that its base portion extends across the extending opening portion of the buckle piece and such that its extending portion extends across the base opening portion of the buckle piece. The free end of the extending portion of the tongue piece may extend to and contact (e.g., overlap with) a major surface of the buckle piece.

Buckle-tongue assemblies in accordance with at least some examples of this invention further may include a single piece, unitary construction. Such assemblies may include a base substrate having one or more slits defined therein, wherein the one or more slits separate the base substrate into a tongue portion and a buckle portion that remain integrally connected together. In some example structures according to this aspect of the invention, at least two conjoined slits separate the base substrate into the tongue portion and the buckle portion. Optionally, the slits may be non-parallel or at least partially non-parallel. In still other example structures according to this aspect of the invention, three conjoined slits may be provided to separate the base substrate into the tongue portion and the buckle portion (optionally, if desired, the slits may be non-parellel, two of the slits may be parallel, some portions of the slits may be parallel, etc.). If desired, at least a portion of the tongue portion may be tapered, e.g., to provide its narrowest width nearest to its free end.

The buckle portion of this assembly may be flexible, e.g., in a manner such that an overall width of the buckle portion will increase under an applied outward force (e.g., a force applied to the opposite sides of the buckle portion) to cause a central length of the buckle portion (in the longitudinal direction) to decrease. The decrease in the central length of the buckle portion may be sufficient to allow the free end of the tongue portion to extend over and contact a surface of the buckle portion, e.g., when the tongue portion is engaged with a strap member.

In some example structures according to this aspect of the invention, at least a first tongue receiving opening will be defined in a strap member that is either engaged with the base substrate or integrally formed with the base substrate. The strap member will have a first width at a location proximate to this first tongue receiving opening, and the one or more slits defining the tongue portion and the buckle portion may include at least two slit areas that are spaced apart in the width direction to thereby provide an opening for the buckle having a second width as its maximum width. The first width may be greater than the second width. In some example structures according to this aspect of the invention, the base substrate may have an overall width at a location proximate to the one or more slits that is the same as or somewhat larger than the overall width of the strap proximate to the first tongue receiving opening. In some more specific examples, the base substrate's overall width will be less than 20% wider, and even less than 15% wider, less than 10% wider, or less than 5% wider than the overall width of the strap proximate to the first tongue receiving opening. In still other example structures according to this aspect of the invention, the base substrate's overall width may be less than 20% narrower, and even less than 15% narrower, less than 10% narrower, or less than 5% narrower than the overall width of the strap proximate to the first tongue receiving opening.

Still additional buckle-tongue assemblies according to examples of this invention may include: (a) a base substrate (which may be a strap member) having a base surface; (b) a buckle portion extending from the base substrate, wherein the buckle portion is formed from a strip of flexible material that has a first end, a second end opposite the first end, and a first major surface, and wherein the strip of flexible material extends from the base substrate such that: (i) the first major surface at the first end of the strip is engaged with the base surface, (ii) the first major surface at the second end of the strip is engaged with the base surface, (iii) at least one twist (e.g., two 90° twists) is formed in the strip between its first end and second end, and (iv) an opening is defined at least in part by the strip; and (c) a tongue portion extending from the base substrate and across the opening defined by the strip. The tongue portion may be separately attached to or integrally formed with the base substrate. If desired, the tongue portion and/or the buckle portion may be reinforced, e.g., by folding or doubling over the material of the construction or in other desired manners.

Additional example aspects of this invention relate to buckle-tongue assemblies that include: (a) a base substrate having a first major surface and a second major surface opposite the first major surface; (b) a buckle portion integrally formed with and extending from the base substrate, wherein the buckle portion includes a first strip of flexible material extending from a first edge of the base substrate and a second strip of flexible material extending from a second edge of the base substrate, wherein a free end of the first strip is engaged with the first major surface of the base substrate at the second edge, and wherein a free end of the second strip is engaged with the second major surface of the base substrate at the first edge; and (c) a tongue portion integrally formed with and extending from the base substrate at a location between the first and second strips. The first strip of flexible material may extend to the second edge of the base substrate such that a free end of the tongue portion extends to an edge of the first strip of flexible material, and the second strip of flexible material may extend to the first edge of the base substrate such that the free end of the tongue portion extends to an edge of the second strip of flexible material (i.e., the strips of flexible material may include one or more twists (e.g., 90° twists) over their longitudinal lengths).

Such assemblies may be produced from blanks that include: (a) a base substrate; (b) a first strip of flexible material defining a first portion of a buckle structure, wherein the first strip of flexible material is integrally formed with and extends from a first edge of the base substrate; (c) a second strip of flexible material defining a second portion of the buckle structure, wherein the second strip of flexible material is integrally formed with and extends from a second edge of the base substrate; and (c) a third strip of flexible material defining at least a tongue portion of the buckle-tongue assembly, wherein the third strip of flexible material is integrally formed with and extends from the base substrate at a location between the first and second strips. The third strip of flexible material may further include a sufficient amount of flexible material so as to provide a loop element.

Additional potential structural features and examples of buckle-tongue assemblies in accordance with examples of this invention will be generally described below.

2. Strap and Buckle Assemblies

Additional aspects of this invention relate to strap and buckle assemblies (e.g., such as belts, watch bands, or the like), and/or securing or fastening elements (e.g., for footwear, handbags, briefcases, purses, containers, books, ledgers, or other objects) including such assemblies. Such assemblies may include, for example: (a) buckle-tongue assemblies of the types described above, and (b) a strap member engaged with or integrally formed with the buckle-tongue assembly, wherein the strap member includes at least one tongue receiving opening defined therein that is engaged by the tongue piece, and wherein the tongue piece holds the strap member and/or presses the strap member against the buckle piece. Strap and buckle assemblies according to aspects of this invention further may include any of the various features and/or characteristics described above (and/or the features or characteristics described in more detail below).

Additional potential structural features and specific examples of articles of footwear and other products that include strap and buckle assemblies in accordance with examples of this invention will be described in more detail below.

3. Methods

Further aspects of this invention relate to methods of forming buckle-tongue assemblies and/or strap and buckle assemblies of the types described above. Such methods may include, for example: (a) providing a base substrate having a width direction and a length direction perpendicular to the width direction (e.g., by manufacturing the base substrate, obtaining it from a third party source, etc.); (b) cutting the base substrate to thereby provide a buckle piece that has an opening defined therethrough and a separate tongue piece; and (c) engaging the tongue piece with the buckle piece such that a first portion of the tongue piece completely spans the opening in the width direction and such that the tongue piece partially spans the opening in the length direction (and optionally contacts a major surface of the base substrate). The base substrate further may include a strap member engaged with or integrally formed as part of the base substrate. Methods according to at least some examples of this invention further may include: engaging one or more loop elements with the buckle piece (or another part of the overall assembly, such as the strap member) to thereby define a slot for receiving a portion of the strap member (e.g., for holding the free end of the strap member).

Methods according to additional example aspects of this invention may include: (a) providing a base substrate made from a flexible material (e.g., by manufacturing the base substrate, obtaining it from a third party source, etc.); and (b) cutting one or more slits in the base substrate, wherein the one or more slits separate the base substrate into a tongue portion and a buckle portion. Again, the base substrate further may include a strap member engaged with or integrally formed as part of the base substrate. Additionally, methods according to this aspect of the invention further may include: engaging one or more loop elements with the buckle portion (or another part of the overall assembly, such as the strap member) to thereby define a slot for receiving a portion of the strap member (e.g., for holding the free end of the strap member).

Still additional methods in accordance with examples of this invention may include: (a) providing a base substrate (such as a strap member) having a base surface and a tongue portion extending from the base substrate; and (b) engaging a buckle portion with the base substrate. In such structures, the buckle portion may be formed from a strip of flexible material that has a first end, a second end opposite the first end, and a first major surface. Furthermore, the strip of flexible material may be engaged with the base substrate such that: (a) the first major surface at the first end of the strip is engaged with the base surface, (b) the first major surface at the second end of the strip is engaged with the base surface, (c) at least one twist is formed in the strip between its first end and second end (e.g., one or more 90° twists), (d) an opening is defined at least in part by the strip, and (e) the tongue portion extends across the opening defined by the strip.

Further methods in accordance with some examples of this invention may include: (a) providing a buckle-tongue assembly blank including: (i) a base substrate having a first major surface and a second major surface opposite the first major surface, (ii) a first strip of flexible material integrally formed with and extending from a first edge of the base substrate, (iii) a second strip of flexible material integrally formed with and extending from a second edge of the base substrate, and (iv) a third strip of flexible material integrally formed with and extending from the base substrate at a location between the first and second strips; (b) engaging a free end of the first strip of flexible material with the first major surface of the base substrate at the second edge of the base substrate; and (c) engaging a free end of the second strip of flexible material with the second major surface of the base substrate at the first edge of the base substrate. If desired, at least a portion of the third strip of flexible material may be doubled or folded over to provide a reinforced tongue portion.

Methods according to examples of this invention further may include forming the tongue portion or tongue piece, the buckle portion or the buckle piece, and/or the strap member to include any of the various features and/or characteristics described above (and/or the features or characteristics described in more detail below). Furthermore, methods of this invention include incorporating structures in accordance with this invention into other objects, such as belts, watch bands, footwear, handbags, briefcases, purses, containers, books, ledgers, or other objects that require closure or securing systems.

B. Specific Examples of Structures and Methods According to the Invention

Features and aspects of this invention now will be described in more detail with specific reference to FIGS. 1A through 9. The reader is advised, however, that this detailed description and the accompanying drawings are provided merely to illustrate examples and features of the invention. The specific description and drawings should not be construed as limiting the invention.

1. Strap and Buckle Assemblies According to Some Examples of the Invention

FIGS. 1A through 1I illustrate a first example strap and buckle assembly according to this invention, as well as its assembly and use. FIG. 1A shows the basic parts that make up the strap and buckle assembly. The first part shown on the far left of FIG. 1A is a strap element 110, which in this illustrated example structure 110 includes a strap base 120 and a strap arm 130. While these elements can take on a variety of shapes without departing from this invention, in this illustrated example, the strap base section 120 and the strap arm section 130 each are generally rectangular shaped, and the strap base 120 is somewhat wider than the strap arm 130 (although the strap arm 130 is longer than the strap base 120). The strap base 120 may include a plurality of holes 122, 124, and 126 that are used in the assembly process to be described in more detail below. The base edge stitch holes 122 are located along the free edge of the strap base 120, the center holes 124 are located in the middle of the strap base 120, and the base strap stitch holes 126 are located closest to the strap arm 130. The strap arm 130 may include a plurality of tongue receiving holes 132, at least one of which may be used during the strap engagement process to be described in more detail below.

Figure 1B:
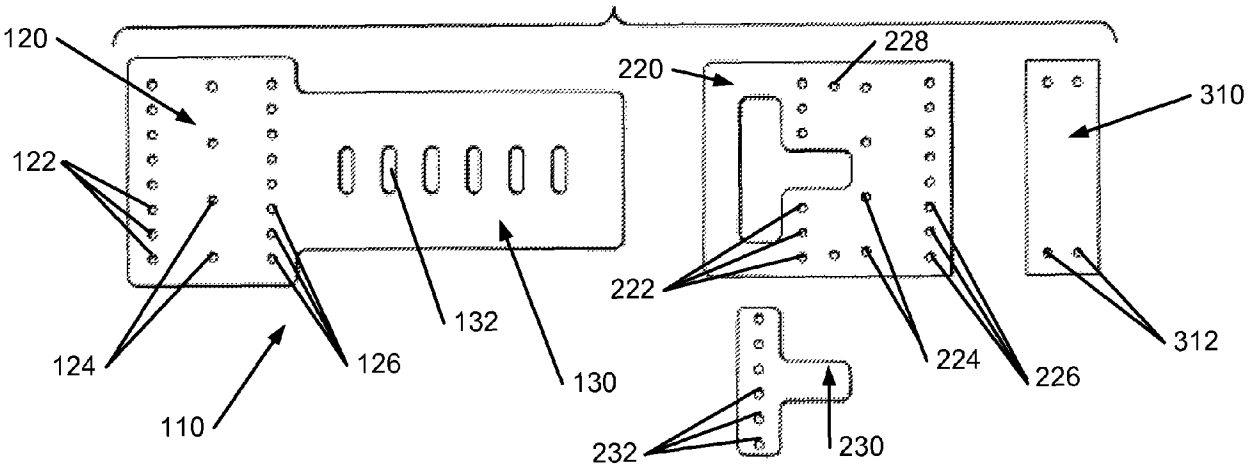

The second part illustrated in FIG. 1A (in the middle) is the buckle-tongue piece 210. This buckle-tongue piece 210 will be further divided into two separate parts, as shown in FIG. 1B, namely a buckle portion 220 and a tongue portion 230. While a variety of shapes may be used without departing from the invention, in this illustrated example, the buckle-tongue piece 210 is generally square or rectangular shaped.

As illustrated in FIG. 1B, the tongue portion 230 may be removed from the buckle-tongue piece 210 to thereby provide two separate pieces, namely, the tongue piece 230 and the buckle piece 220. In at least some example structures according to this invention, the tongue piece 230 may be generally T-shaped, and when it is cut out, it leaves a generally T-shaped opening in the buckle piece 220. The tongue piece 230 may include a plurality of stitch holes 232 that may be used in the buckle assembly process described below. The buckle piece 220 also may include a plurality of holes 222, 224, 226, and 228 that also may be used in the buckle assembly process described below. Stitch holes 222 are located near the middle of the buckle piece 220 and adjacent the location from where the tongue piece 230 is removed. Holes 224 are located beyond the opening formed by the removal of the tongue piece 230, and the buckle edge stitch holes 226 are located at the end of the buckle piece 220 opposite from where the tongue piece 230 was removed. Loop assembly stitch holes 228 are located on the side of the buckle piece 220 between stitch holes 222 and holes 224. Other constructions of parts and/or arrangements of various elements on the buckle piece 220 and the tongue piece 230 may be used without departing from this invention.

FIGS. 1A and 1B further illustrate a loop element 310 that may be included with at least some structures in accordance with this invention. While any shapes may be used, in this illustrated example, the loop element 310 is generally rectangular in shape. The loop element 310 may include a plurality of stitch holes 312 along each of its sides.

Figure 1C:
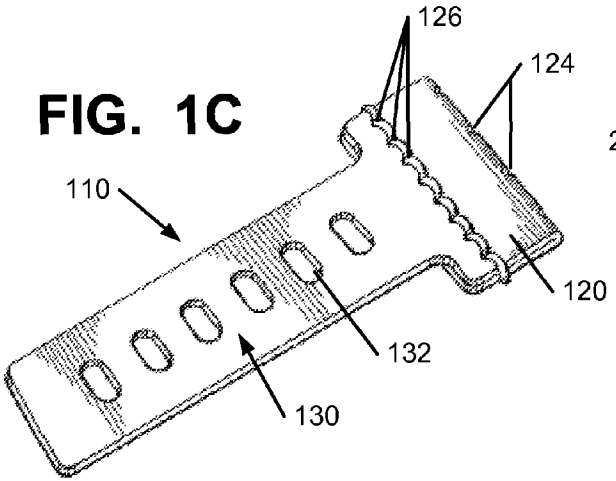

FIGS. 1C through 1F illustrate additional example features of a strap and buckle assembly production process that may be used in accordance with at least some examples of this invention (e.g., to produce a strap and buckle assembly from the parts described in conjunction with FIGS. 1A and 1B). Starting with the four parts 110, 220, 230, and 310 illustrated in FIGS. 1A and 1B, first the strap member 110 is readied for inclusion in a strap and buckle assembly. While the strap member 110 may be used in the form shown in FIGS. 1A and 1B, if desired, as illustrated in FIG. 1C, the strap base edge 120 may be folded over at the center holes 124 (while the center holes 124 may be omitted, if desired, they can help in making the folded edge lay flatter, fold more easily, etc.). The center holes 124 also may be used in attaching the strap member 110 to another structure (e.g., by stitching or tying), and the folding of the strap member 110 (as shown in FIG. 1C) can conceal the threads or knots that hold the strap member 110 to the other structure. Following the folding, the strap edges may be attached together by sewing through stitching holes 122 and 126. Optionally, if desired, this sewing step also may be used to attach the strap member 110 to another object, such as to an object to be closed using the buckle structure (e.g., an article of footwear, a briefcase, a purse, a backpack, a container, a book, etc.). Separate sewing steps or other suitable attachment steps also may be used to attach the strap member 110 to the other object, if such attachment is desired. Also, if desired, the folding step may be omitted.

Figure 1E:
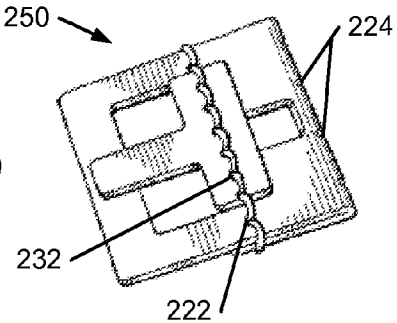

Another next step in the strap and buckle assembly process includes formation of the buckle-tongue assembly 250. As shown in FIG. 1D, first the tongue piece 230 is cut out from the buckle-tongue blank piece 210 (e.g., using a cutting procedure, such as die cutting, laser cutting, water jet cutting, or other cutting procedures). Once cut out, the tongue piece 230 has the same perimeter shape as the opening 252 that is left in the buckle piece 220. The tongue piece 230 is then flipped or rotated and laid over the opening 252 in the buckle piece 220 as shown in FIGS. 1D and 1E (e.g., so that the wider base portion of the tongue piece 230 extends across the narrower portion of the opening 252 in the buckle piece 220 and such that the extending portion of the tongue piece 230 extends across the wider portion of the opening 252 in the buckle piece 220 and engages the surface of the buckle piece 220 near its free end). The buckle piece 220 then may be folded along center holes 224, and the buckle piece 220 and the tongue piece 230 then may be engaged together via sewing (e.g., through stitching holes 222 and 226 in buckle portion 220 and through stitching holes 232 in buckle portion 230). Again, while the center holes 224 may be omitted, if desired, they can help in making the folded edge lay flatter, fold more easily, etc. The center holes 224 also may be used in attaching the buckle piece 220 to another structure (e.g., by stitching or tying), and the folding of the buckle piece 220 (as shown in FIG. 1E) can conceal the threads or knots that hold the buckle piece 220 to the other structure. Once engaged, the final buckle-tongue assembly 250 of this example structure may appear as shown in FIG. 1E. Optionally, if desired, this sewing step also may be used to attach the buckle-tongue assembly 250 to another object, such as an object to be closed using the buckle structure (e.g., an article of footwear, a briefcase, a purse, a backpack, a book, a container, etc.). Separate sewing steps or other suitable attachment steps also may be used to attach the buckle-tongue assembly 250 to the other object, if such attachment is desired.

As noted above, the various assembly steps described above use sewing for attaching the various parts together. Other forms of attachment may be used, such as stapling, riveting, mechanical connectors, retaining element structures, cements or adhesives, or any other method that will engage the tongue piece 230 with the buckle piece 220.

Figure 1F:
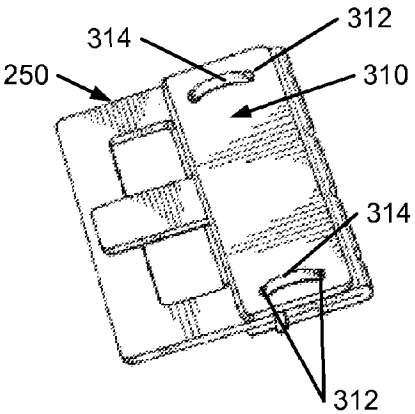
Figure 1D:
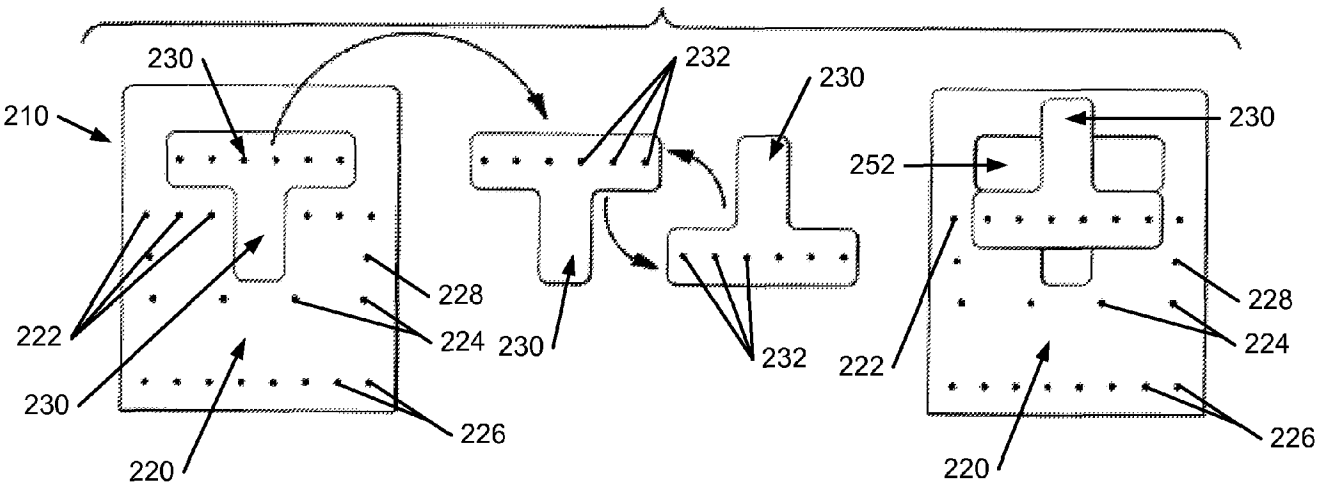

Another potential assembly step is illustrated in FIG. 1F, namely, attachment of the loop element 310 to the buckle-tongue assembly 250. During the loop assembly, the loop 310 may be placed on top of the buckle-tongue assembly 250. The loop element 310 then may be attached to the buckle-tongue assembly 250 via engagement elements 314 on each end of the loop 310 (through holes 312). The attached loop element 310 creates a slot through which the free end of the strap 110 may be threaded in order to keep it in place. Again, while the attachment of loop element 310 is shown in this illustrated example as being attached via sewing and stitching, any form of attachment may be used, such as stapling, riveting, mechanical connectors, retaining elements, cements or adhesives, etc., without departing from this invention. Optionally, if desired, this sewing step (or other type of attachment step) also may be used to attach the buckle-tongue assembly 250 (with the loop 310) to another object, such as an object to be closed using the buckle structure (e.g., an article of footwear, a briefcase, a purse, a backpack, a book, a container, etc.). Separate sewing steps or other suitable attachment steps also may be used to attach the buckle-tongue assembly 250 to the other object, if such attachment is desired. As another option, if desired, the tongue piece 230 can be attached to the buckle piece 220 along with the loop element 310. As yet another example, if desired, the loop element 310 may be engaged with another portion of the overall system, such as the strap 110, the object to which the buckle and strap assembly is attached, etc.

Figure 1G:
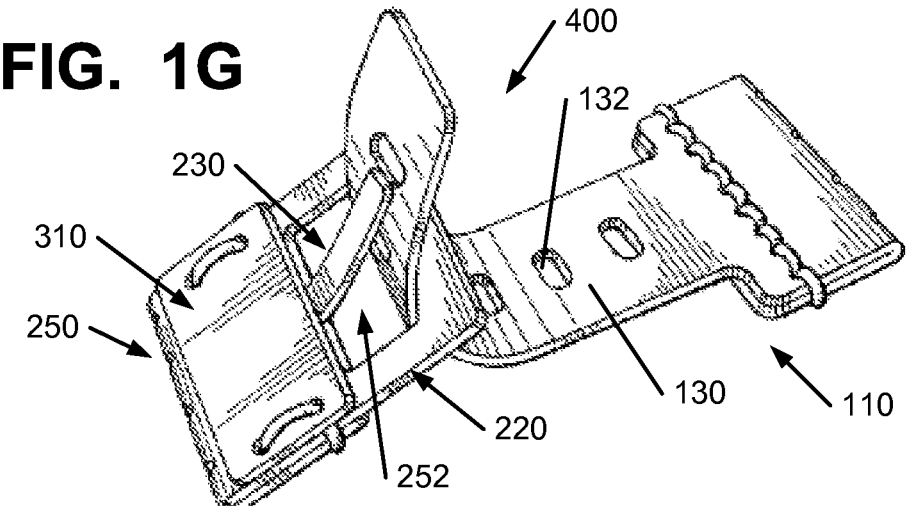
Figure 1H:
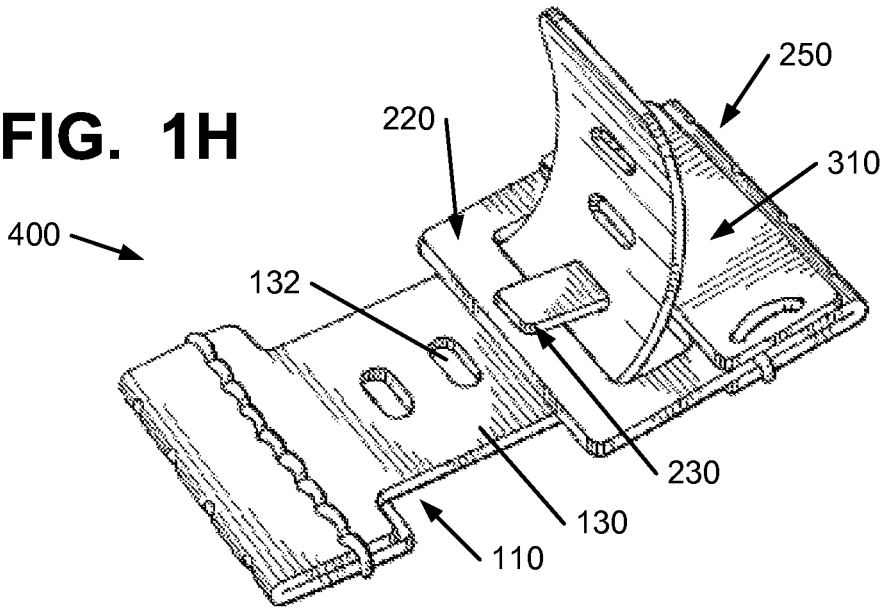
Figure 1I:
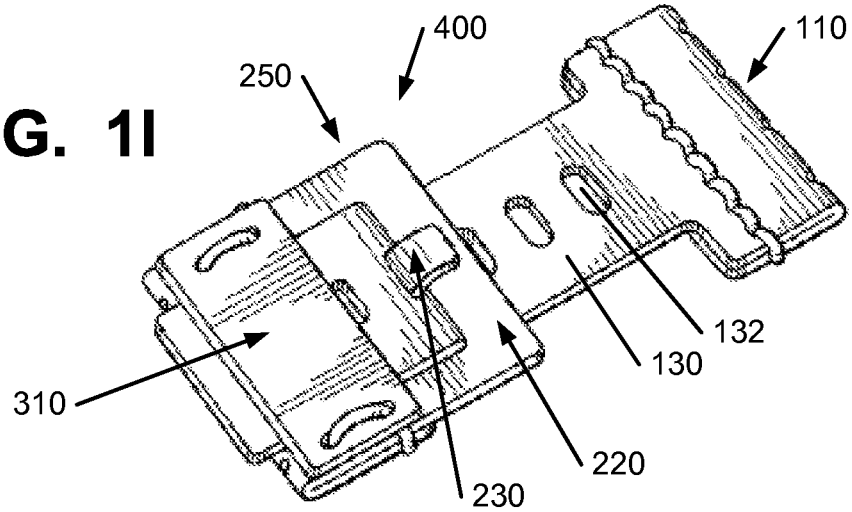

FIGS. 1G through 1I illustrate an example of engagement of a strap and buckle assembly 400 like that described above in conjunction with FIGS. 1A through 1F. In essence, this strap and buckle assembly 400 functions in the same manner as conventional strap and buckle assemblies. First, as illustrated in FIG. 1G, the strap portion 130 of the strap member 110 is inserted beneath the front edge of the buckle piece 220 and through the opening 252 in the buckle piece 220 (the opening from which the tongue piece 230 was cut). The strap portion 130 is pulled to a desired tension or location (against the edge of the opening 252 defining the front edge of the buckle piece) and pulled back to allow the free end of the tongue piece 230 to be inserted into one of the tongue receiving openings 132 in the strap member 110 (see FIG. 1H). Notably, the free end of the tongue piece 230 extends to and overlaps with a surface of the buckle piece 220 located proximate to the front edge of the buckle piece 220. Then, as shown in FIG. 1I, the free end of the strap portion 130 is inserted into the slot defined by the loop member 310, to help hold the strap portion 130 in place.

2. Reduced/Minimal Waste Constructions for Strap and Buckle Assemblies

While the various parts of a strap and buckle assembly may be made from any desired materials and/or in any desired shapes or constructions without departing from this invention, in accordance with at least some examples of this invention, the various parts of the buckle and strap assembly may be made from suitable materials and in suitable shapes and constructions so as to: (a) minimize waste, (b) reduce or eliminate the use of polymers, adhesives, or cements, hardware, etc., and/or (c) eliminate the need for complex and expensive molding steps. In at least some structures according to this invention, the material will be soft, flexible, and supple (e.g., so as to conform to the shape of a wearer's foot, to be sufficiently comfortable, to be sufficiently flexible, etc.) while still sufficiently strong and stiff so as to properly function as the closure system. Examples of suitable materials that may be used in accordance with at least some examples of this invention include: leather, synthetic leather, suede, other textile or fabric materials, papers, cardboard, plastics, etc.

Figure 2A:
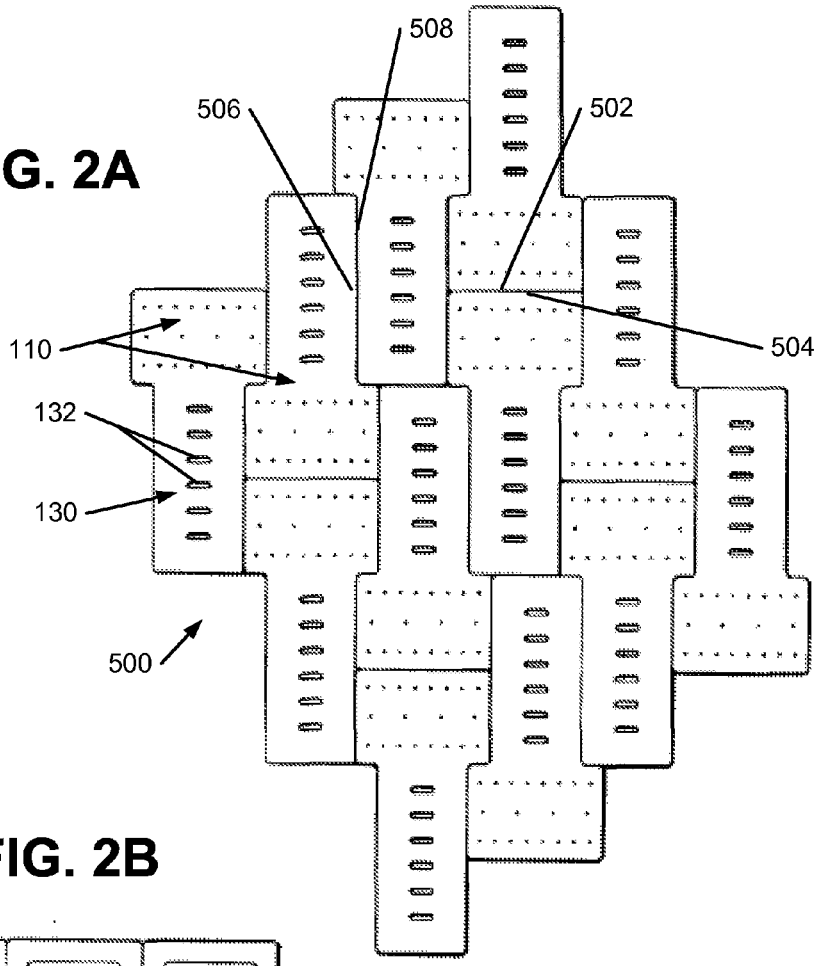
FIGS. 2A through 2C illustrate examples of compact and tessellated layouts for the various parts of a strap and buckle assembly according to FIGS. 1A through 1I.
Figure 2B:
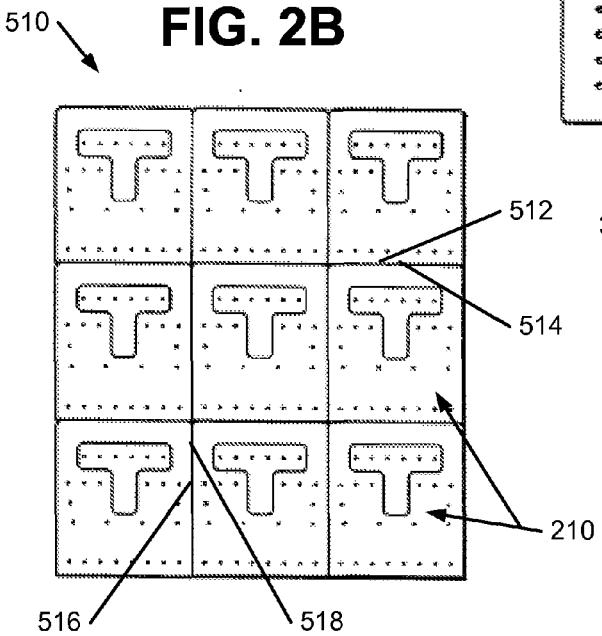
Figure 2C:
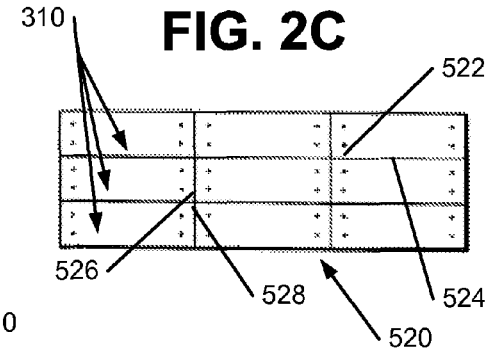
Figure 3:
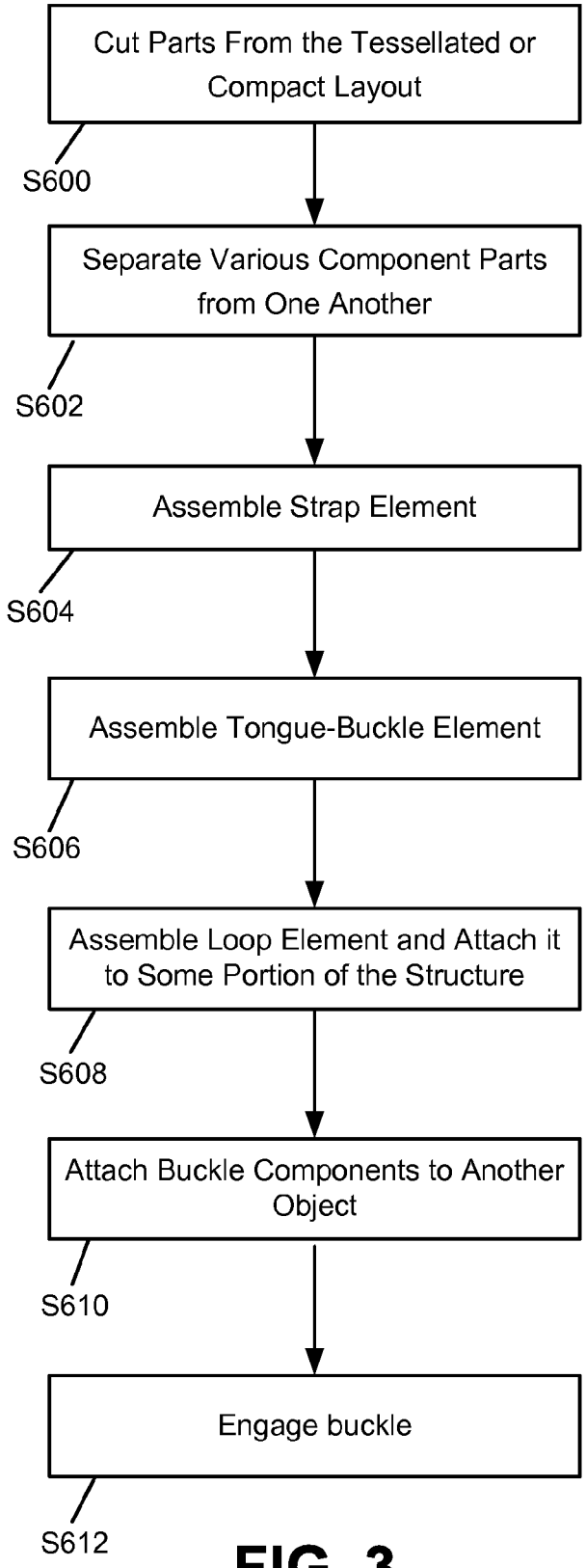
FIG. 3 illustrates an example procedure for making and using a strap and buckle assembly according to at least some examples of this invention.

The example strap and buckle assembly 400 illustrated in FIGS. 1A through 1I lends itself to production techniques that will produce minimal waste. FIGS. 2A, 2B, and 2C illustrate examples of blank materials 500, 510, and 520 (e.g., made from one or more of the materials described above), respectively. These figures further illustrate cutting patterns in these blank materials 500, 510, and 520 that may be used to produce the strap member 110, the buckle-tongue blank 210, and the loop member 310, respectively, described above. As shown in FIG. 2A, the cutting pattern for the strap member 110 may be provided in a tessellated (or other compact) arrangement, e.g., so as to result in a low or minimal amount of waste. In this illustrated example layout, each strap edge is located immediately adjacent and co-existent to an edge of another strap. For example, the bottom edge of one strap 502 may lie immediately adjacent the bottom edge of another strap 504. Also, the side edge of one strap 506 may lie immediately adjacent the side edge of another strap 508. With this tessellated layout 500, there is little waste associated with the formation of numerous strap elements 110 (e.g., the only "wasted" material in this example layout constitutes the material cut out for the tongue receiving holes 132, the material cut out for the stitch or fold line holes (if any), and the material located at an extreme edge portion of the overall material blank). In this example structure, as shown in FIG. 2A, each strap arm 130 is about two times longer in the longitudinal direction than the strap base 120. In accordance with at least some examples of this invention, the overall waste material produced in making strap members 110 will constitute less than 10% of an overall surface area of the material from which the strap members 110 are cut, and in some examples, the amount of waste will be less than 5% of the overall surface area, or even less than 2% or 1% of the overall surface area.

One skilled in the relevant art, given the benefit of this disclosure, will recognize that the tessellated layout 500 depicted in FIG. 2A is only an example of a way to design a tessellated layout 500 for the strap member 110, and that, depending on the design and shape of the strap 110, numerous other layouts could be utilized in order to create a low or minimal waste arrangement.

FIG. 2B depicts a tessellated or compact layout 510 of the example buckle-tongue blank piece 210 described above. In the illustrated example, each buckle-tongue piece 210 may be in the shape of a square or rectangle, and each buckle-tongue piece edge may be located immediately adjacent and co-existent to an edge of another buckle-tongue piece 210. As some more specific examples, as illustrated in FIG. 2B, the bottom edge 512 of one buckle-tongue piece 210 may lie immediately adjacent the top edge 514 of another buckle-tongue piece 210, and the side edge 516 of one buckle-tongue piece 210 may lie immediately adjacent the opposite side edge 518 of another buckle-tongue piece 210.

With this tessellated or compact layout 510, there is little waste associated with the formation of numerous buckle-tongue pieces 210 (e.g., the only "wasted" material in this example layout constitutes the material cut out for the stitch or fold line holes (if any) and/or the material located at an extreme edge portion of the overall material blank). In accordance with at least some examples of this invention, the overall waste material produced in making buckle-tongue pieces 210 will constitute less than 10% of an overall surface area of the material from which the buckle-tongue pieces 210 are cut, and in some examples, the amount of waste will be less than 5% of the overall surface area, or even less than 2% or 1% of the overall surface area.

One skilled in the relevant art, given the benefit of this disclosure, will recognize that the compact layout 510 depicted in FIG. 2B is only an example of a way to design a layout 510 for the buckle-tongue piece 210, and that, depending on the design and shape of the buckle-tongue piece 210, numerous other layouts could be utilized in order to create a low or minimal waste arrangement.

If desired, at the same time that the individual buckle-tongue pieces 210 are cut from the layout 510, the tongue piece 230 may be cut out from the remainder of the buckle-tongue piece 210 to thereby form the opening 252 in the buckle piece 220, e.g., as shown in FIG. 1D. The various cutting steps will be described in more detail below.

FIG. 2C depicts a tessellated or compact layout 520 of the example loop element 310 described above. In the illustrated example, each loop element 310 may be generally in the shape of a rectangle, and each loop element edge may be located immediately adjacent and co-existent to an edge of another loop element. As some more specific examples, as illustrated in FIG. 2C, the bottom edge 522 of one loop element 310 may lie immediately adjacent the top edge 524 of another loop element 310, and the side edge 526 of one loop element 310 may lie immediately adjacent the opposite side edge 528 of another loop element 310.

With this tessellated or compact layout 520, there is little waste associated with the formation of numerous loop element 310 (e.g., the only "wasted" material in this example layout constitutes the material cut out for the stitch or fold line holes (if any) and/or the material located at an extreme edge portion of the overall material blank). In accordance with at least some examples of this invention, the overall waste material produced in making loop element 310 will constitute less than 10% of an overall surface area of the material from which the loop element pieces 310 are cut, and in some examples, the amount of waste will be less than 5% of the overall surface area, or even less than 2% or 1% of the overall surface area.

One skilled in the relevant art, given the benefit of this disclosure, will recognize that the compact layout 520 depicted in FIG. 2C is only an example of a way to design a layout 520 for the loop element 310, and that, depending on the design and shape of the loop element 310, numerous other layouts could be utilized in order to create a low or minimal waste arrangement.

FIGS. 2A through 2C illustrate the various component parts of this example strap and buckle assembly 250 (i.e., strap element 110, buckle-tongue element 210, and loop element 310) on separate material blanks 500, 510, and 520, respectively. This is not a requirement. Rather, if desired, two or more of these elements 110, 210, and 310 may be cut from a single piece of material and/or the various elements may be intermixed on a given piece of material. For example, the cut outs for the buckle-tongue piece 210 and/or the loop element 310 may be provided around and/or between cut outs for the strap element 110 and/or along edges of the cutouts for the strap elements 110. Given the relatively small size and regular square or rectangular shape of these example individual buckle-tongue pieces 210 and/or the loop elements 310 (as compared to the strap element 110), an intermingled arrangement of cut outs for the buckle-tongue piece 210 and/or the loop element 310 on a single piece of material along with cut outs for the strap element 110 can further help reduce waste.

3. Example Strap and Buckle Assembly Production Processes

While various features of the strap and buckle assembly process are described above, FIG. 3 provides a flowchart of an example process that may be used in accordance with at least some examples of this invention. The first step S600 of the illustrated assembly process includes cutting out the various components of the strap and buckle assembly (e.g., the strap member 110, the buckle-tongue member 210 (including cutting out and separating the tongue piece 230 from the buckle piece 220), and the loop element 310). This cutting step S600 may be performed in any desired manner, including manners that are conventionally known or used in the art, such as die cutting, rotary cutting, laser cutting, water jet cutting, saw cutting, hand cutting, leather punching, etc. Once cut, the individual components are separated from one another 5602.

This step may be performed manually or through an automated process (e.g., such as a shaking process, a rotary drum rolling process, etc.).

After the component parts are separated from one another, the strap and buckle assembly process begins. As one step S604, the strap element 110 may be formed, e.g., in the manner described above in conjunction with FIG. 1C. As another step S606, the buckle-tongue assembly 250 may be formed, e.g., in the manner described above in conjunction with FIGS. 1D and 1E. As yet another step S608, the loop assembly 310 is formed and added to the buckle-tongue assembly 250, e.g., as described above in conjunction with FIG. 1F. Alternatively, if desired, the loop element 310 may be engaged with a different element in the overall structure, such as with a strap element (such as strap element 110) and/or with an element to which the buckle-tongue assembly 250 or the strap member 110 is attached.

Once the various component parts are assembled, the next step S610 of this example assembly process includes attachment of the various components of the strap and buckle assembly 400 to a desired component. The strap and buckle assembly 400 may be attached to and used as a closure or securing system for any type of element without departing from this invention, including footwear, watches, handbags, briefcases, backpacks, purses, carrying cases (e.g., for cameras, cellular telephones, other electronic elements, etc.), other containers, doors, drawers, books, ledgers, etc. The strap and buckle assembly 400 may be engaged with the other object in any desired manner without departing from this invention, including by sewing or stitching (optionally during the sewing steps (if any) used in forming the strap member 110, the buckle-tongue piece 250, and/or the loop element 310); by cements or adhesives; by staples, rivets or other mechanical connectors; by interlocking or other retaining element structures; etc. Once mounted, the strap and buckle assembly may be used (Step S612), e.g., in the manner described above in conjunction with FIGS. 1G through 11 (or in other conventional manners).

The process described above in conjunction with FIG. 3 is simply an example of various steps in a process that may be used in accordance with this invention. Many variations in the assembly and use process are possible without departing from this invention. For example, the various process steps described above may be changed (e.g., to be performed in different manners), changed in order, or omitted, without departing from this invention. Additionally or alternatively, other process steps may be added to the procedure or used to replace one or more of the steps in the described procedure without departing from this invention. The various steps in the process also may be performed separately, simultaneously, or in combinations without departing from this invention.

4. A Belt Type Strap and Buckle Assembly

Figure 4A:
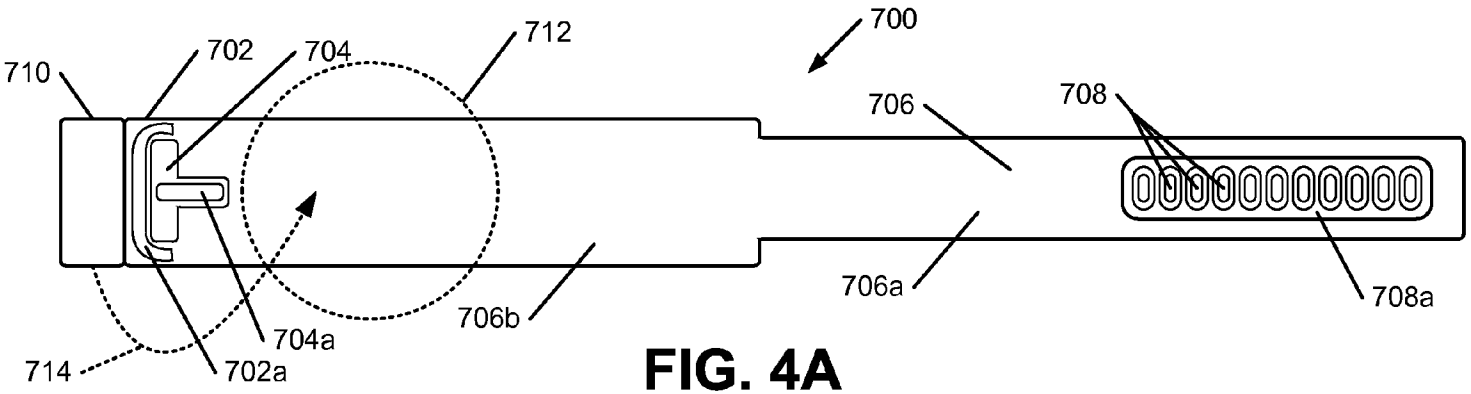
FIG. 4A illustrates an example belt structure including a strap and buckle assembly according to this invention.
Figure 4B:
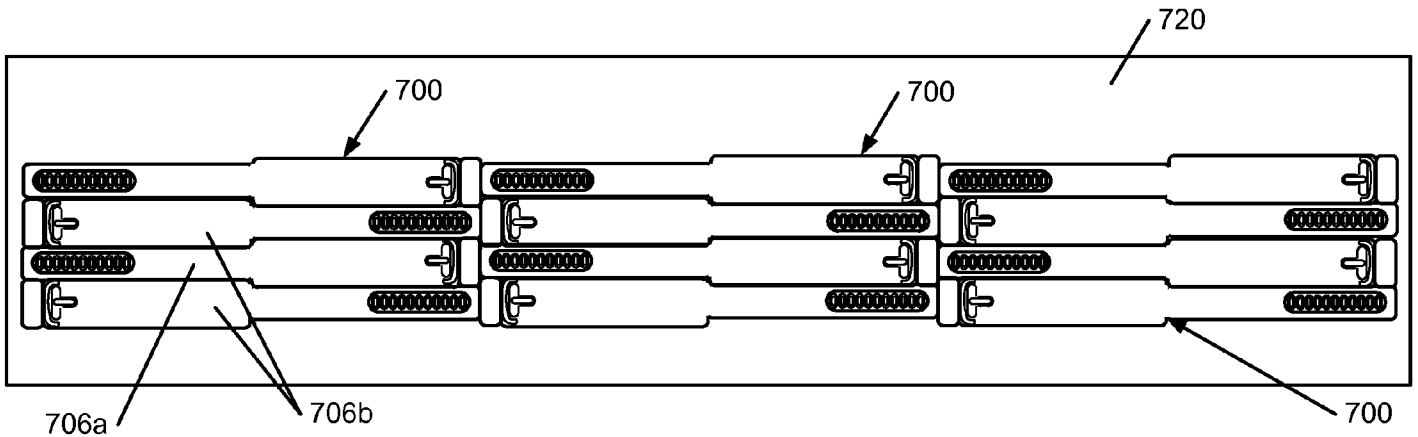
FIG. 4B illustrates an example compact and tessellated layout for the belt structure of FIG. 4A.

The specific example structure described above includes separate strap and buckle elements that are separately attached to other objects, such as footwear, watches, handbags, briefcases, backpacks, purses, carrying cases (e.g., for cameras, cellular telephones, other electronic elements, etc.), other containers, doors, drawers, books, ledgers, etc. This is not a requirement. Rather, strap and buckle assemblies according to at least some examples of this invention may include an integrally formed strap and buckle construction, e.g., to provide a belt type structure. FIGS. 4A and 4B illustrate an example of such a structure. As shown in FIG. 4A, the belt structure 700 includes a buckle portion 702, a tongue portion 704 (which may be cut out from the buckle portion 702 and reattached as described above in conjunction with FIGS. 1D and 1E), and a strap portion 706 (with one or more tongue receiving openings 708 defined therein). In this illustrated example structure 700, a loop element 710 also is provided, which may be cut away from the buckle portion 702 and attached to some other portion of the overall structure 700 (such as to the belt strap area 712 nearer to the buckle end of the overall belt), e.g., in the manner described above in conjunction with FIG. 1F and as shown by broken lines and the arrow 714 in FIG. 4A.

FIG. 4B illustrates a material blank 720 that includes an example tessellated or compact layout pattern for several belt structures 700 of the type described above that may be used in accordance with this invention. As evident from FIG. 4B, the layout and cutting pattern of this example structure is provided in a tessellated (or other compact) arrangement, e.g., so as to result in a low or minimal amount of waste (e.g., the only "wasted" material in this example layout constitutes the material cut out for the tongue receiving holes and the material at an extreme edge portion of the overall material blank 720). In this illustrated example structure 700, the narrower portion 706*a* of the strap portion 706 is approximately the same length as the combined lengths of the wider strap portion 706*b* and the loop element 710. This feature allows the narrower strap portion 706*a* of one strap 700 to be sandwiched between the wider strap portions 706*b* and loop element portions 710 of two adjacent straps 700. In accordance with at least some examples of this invention, the overall waste material produced in making these illustrated belt members 700 will constitute less than 10% of an overall surface area of the material from which the belt members 700 are cut, and in some examples, the amount of waste will be less than 5% of the overall surface area, or even less than 2% or 1% of the overall surface area.

One skilled in the relevant art, given the benefit of this disclosure, will recognize that the compact or tessellated layout depicted in FIG. 4B is only an example of a way to design a compact or tessellated layout for the belt member 700, and that, depending on the design and shape of the belt member 700, numerous other layouts could be utilized in order to create a low or minimal waste arrangement. Also, if desired, the loop element 710 may be omitted from the structure and/or provided from a different blank material.

FIG. 4A illustrates additional features that may be provided in structures in accordance with at least some examples of this invention. FIG. 4A illustrates that various areas of the belt member 700 may include features to locally reinforce the belt member 700 (e.g., such as to stiffen or strengthen various localized areas). The reinforced areas may include, for example, at least some portion of the tongue member 704 (such as the strap engaging extension 704*a*), at least some portion of the buckle member 702 (such as the tongue and strap engaging portion 702*a*), and/or at least some portion of the strap member 706 (such as one or more areas 708*a* around the tongue receiving openings 708). Any types of reinforcement may be provided without departing from this invention, including, but not limited to: application of an additional layer of the material of the belt member 700; application of a chemical agent to stiffen or strengthen the material of the belt member 700; inclusion of stitching, metal, plastic, or other mechanical reinforcing elements at desired locations of the belt member 700; laser, ultrasonic, heat, or other radiation treatments of portions of the belt member 700; etc. As additional examples, if desired, the material of the tongue member 704 may be rolled, folded, or otherwise layered or doubled over to provide enhanced thickness and strength. Any desired way of reinforcing one or more areas of the belt member 700 may be used without departing from this invention.

5. Alternative Strap and Buckle Assemblies According to Examples of this Invention FIGS. 5A through 5H illustrate another example strap and buckle assembly according to this invention. While the illustrated example shows a belt type structure 800, this example buckle assembly (described in more detail below) can be used as a two part strap and buckle assembly (i.e., with the buckle and tongue portion separated from the strap portion), e.g., by cutting the belt type structure 800 at some location along the strap or by forming the two end portions separately.

This illustrated belt type structure 800 includes two main parts, namely: (a) the belt member 802 and (b) the loop member 810. The belt member 802 in this illustrated example includes a buckle-tongue portion 804 at one end and a strap portion 806 with one or more tongue receiving openings 808 defined therein at the other end. The tongue receiving openings 808 may be cut into the material of the strap portion 806, e.g., by die cutting, laser cutting, or another cutting process, such as the various processes described above. The strap portion 806 may constitute a single member that extends completely between the buckle-tongue portion 804 and the opposite free end, or it may be made from one or more different materials or members without departing from this invention.

Figure 5A:
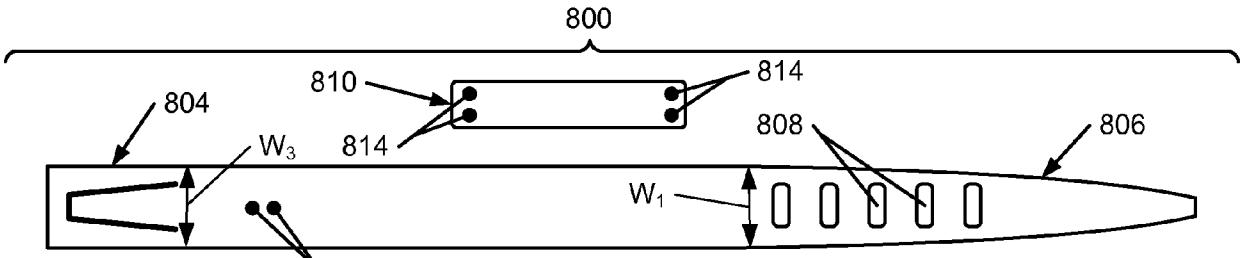
FIGS. 5A through 5H illustrate another example belt structure including a strap and buckle assembly according to another example of this invention.
Figure 5C:
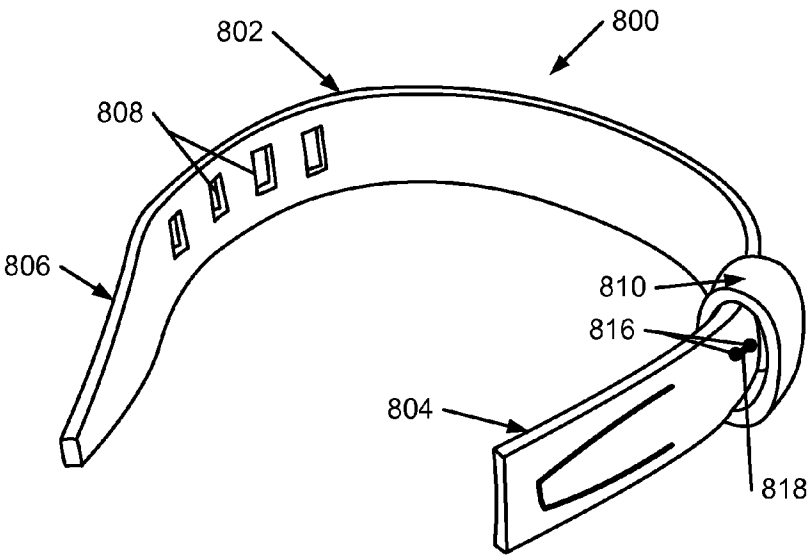
Figure 5B:
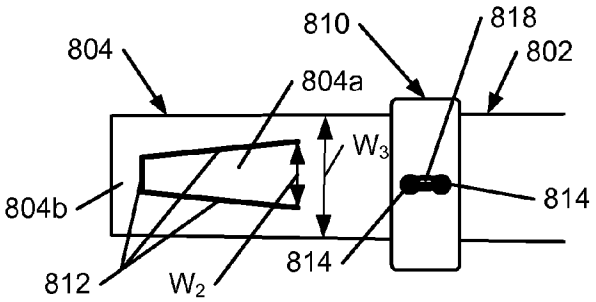

The buckle-tongue portion 804 of this example structure 800 differs from those illustrated in FIGS. 1A through 4B. As shown in FIGS. 5A through 5C, the buckle-tongue portion of this strap is formed by cutting one or more slits 812 through the strap member 806 at one end thereof. This cutting (e.g., such as through die cutting, rotary cutting, laser cutting, water jet cutting, saw cutting, hand cutting, etc.) defines a tongue portion 804*a* and a buckle portion 804*b* at one end of the structure 800 (see FIG. 5B), including an opening 804*c* through which the free end of the strap member 806 may be received, as illustrated in FIGS. 5E-5G. For reasons to be described in more detail below, the buckle-tongue portion 804 in this example structure 800 will be made of a strong but flexible material, such as leather, synthetic leather, plastics, or the like.

Figure 5D:
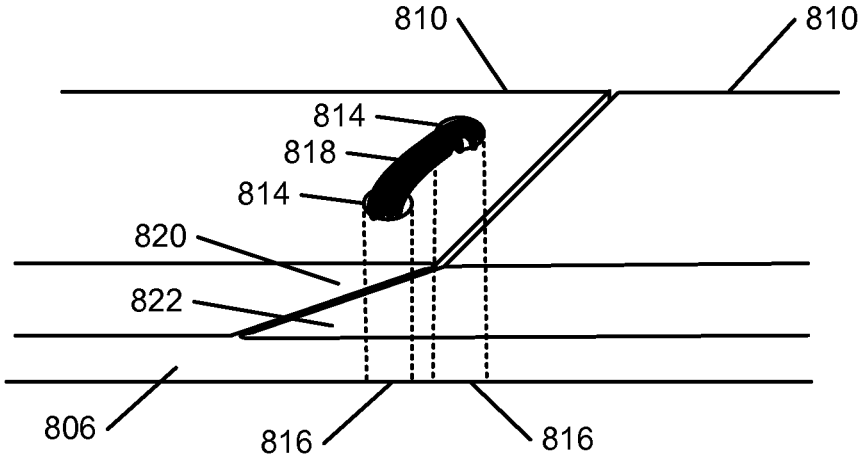
Figure 5E:
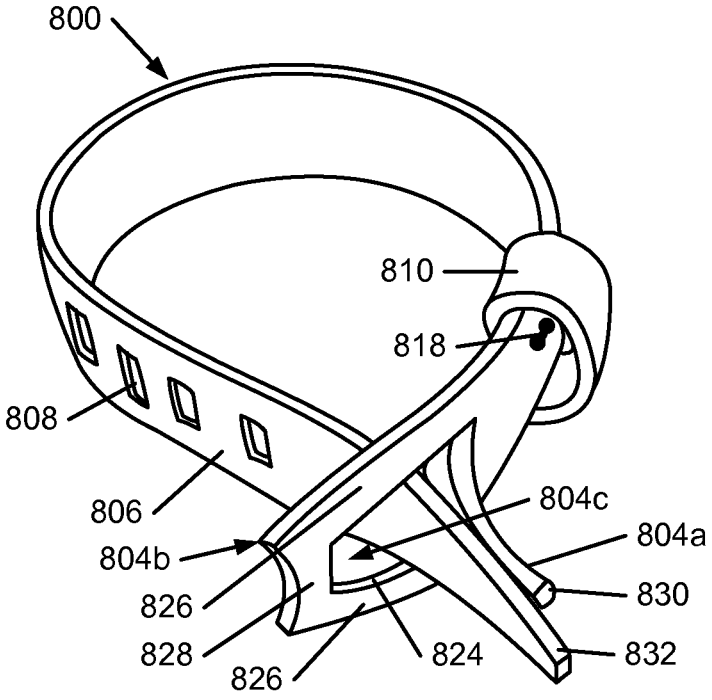
Figure 5F:
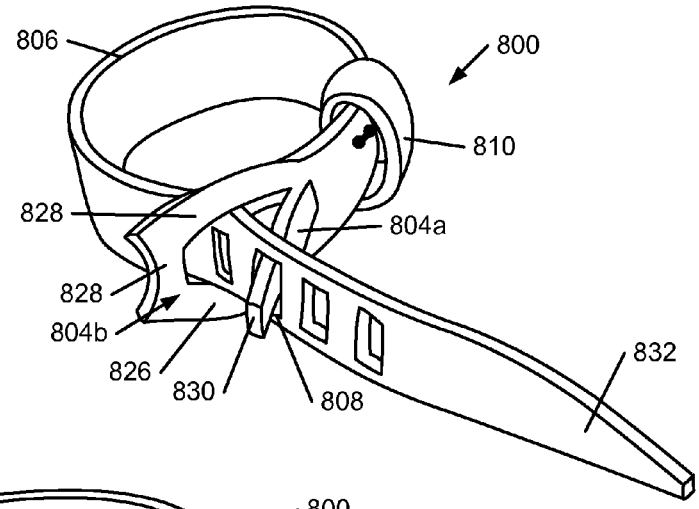
Figure 5G:
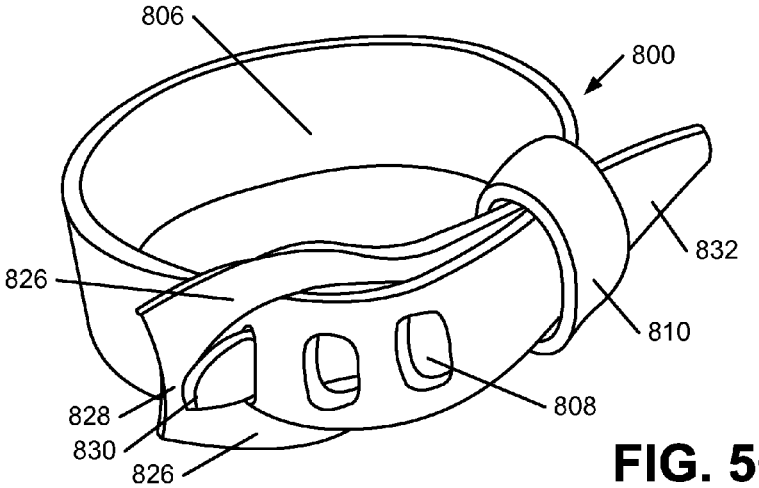
Figure 5H:
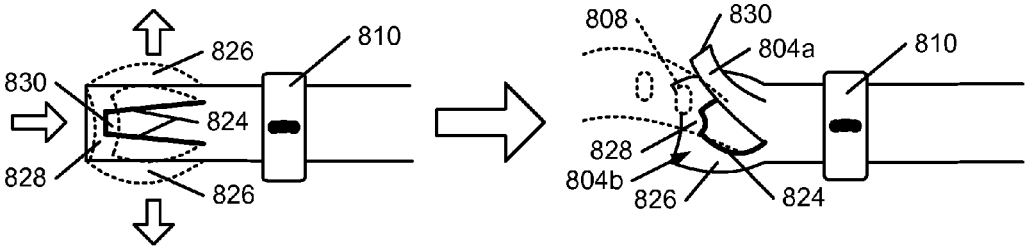

FIGS. 5B through 5D further illustrate attachment of the loop element 810 to the strap member 806. While the loop element 810 may be engaged with the strap member 806 at any desired location along the strap member 806, in this illustrated example, the loop element 810 is engaged with the strap member relatively close to the buckle-tongue portion 804. The loop member 810 of this example structure 800 includes stitching holes 814 at each end thereof, and the strap member 806 includes stitching holes 816 at the desired location for mounting the loop member 810. The loop member 810 may be engaged with the strap member 806 by thread or another type of connection member 818 (or other connection means) provided through holes 814 and 816. Other ways of attaching the loop member 810 also may be used without departing from this invention, such as adhesives, mechanical connectors, etc. As another alternative, if desired, the loop member 810 need not be attached to the strap member 806 (e.g., it may move freely along at least some portion of the strap's longitudinal length, if desired). Also, if desired, the loop element 810 may be omitted or more than one loop element 810 may be provided without departing from the invention.

FIG. 5D illustrates an enlarged view of the attachment of the loop member 810 to the strap member 806. As shown in FIG. 5D, the free ends 820 and 822 of the loop member 810 may be tapered in the thickness direction so that when the loop member 810 is assembled and joined to the strap member 806, the overall surface of the loop member 810 remains relatively smooth. This feature can be advantageous to provide a less bulky or thick connection structure at the loop element 810, e.g., as compared to a double layered connection. This feature also can be advantageous for use in articles of wear, such as articles of clothing, footwear, watchbands, etc., to provide a more comfortable fit. Other types of joints are possible without departing from this invention, such as abutting edge joints, tongue and groove joints, etc.

FIGS. 5E through 5H illustrate example engagement of the belt member 800 in accordance with this example of the invention. As shown, the free end of strap member 806 is inserted into the opening 804*c* provided by the slits 812 cut into the buckle-tongue portion 804 of the belt member 800. The force applied against the inside walls 824 of the opening 804*c* causes the side walls 826 of the buckle portion 804*b* to expand outward, which causes the central portion of the end wall 828 of the buckle portion 804*b* to pull inward, toward the tongue portion 804*a*. Note FIG. 5H. This action pulls the central portion of the end wall 828 inward enough so that the tip 830 of the tongue portion 804*a* can engage the surface of the end wall 828 after the tip 830 is pushed through one of the tongue receiving openings 808. Once the tongue portion 804*a* is engaged with the tongue receiving opening 808 and the end wall 828 surface, the free end 832 of the strap member 806 may be pushed through a slot provided by the loop member 810.

As noted above, in at least some example structures according to this aspect of the invention, the buckle-tongue portion 804 will be made from a flexible material to allow the walls of the buckle portion to flex somewhat under an applied force. This applied force may be generated by making the width $W_1$ of the portion of the strap member 806 that will be inserted through the opening 804*c* (e.g., located adjacent the tongue receiving openings 808) somewhat wider than the largest width $W_2$ of the opening 804*c* (i.e., wider than the maximum distance between slits 812). If desired, these widths may have the following relationships:

$$W_1=1.05\times W_2 \text{ to } 1.6\times W_2, \text{ or in some instances,}$$

$$W_1=1.1\times W_2 \text{ to } 1.3\times W_2.$$

As additional examples, if desired, the overall width $W_3$ of the belt member at the location of the slits 812 forming the opening 804*c* in the buckle member 804 (in an unstressed condition) may have the following relationships:

$$W_3=1.05\times W_2 \text{ to } 1.6\times W_2, \text{ or in some instances,}$$

$$W_3=1.1\times W_2 \text{ to } 1.3\times W_2.$$

In some example structures according to this invention, $W_3$ will equal $W_1$ or $W_3$ will be no more than 10% wider than $W_1$ or even no more than 5% wider than $W_1$.

Any number of slits 812, in any desired construction or arrangement, may be provided in the buckle-tongue portion 804 to define the tongue portion 804*a* and the buckle portion 804*b* without departing from this invention. While the illustrated example structure includes three conjoined slits 812, more or fewer slits may be used. For example, a single slit (e.g., a curved or continuous structure, making a U-shaped free end) or two slits (making a V-shaped free end) may be used. The slits defining opposite sides of the opening in the buckle portion 804*b* also may be parallel, tapered, parallel in part, stepped, etc., without departing from the invention.

Figure 6:
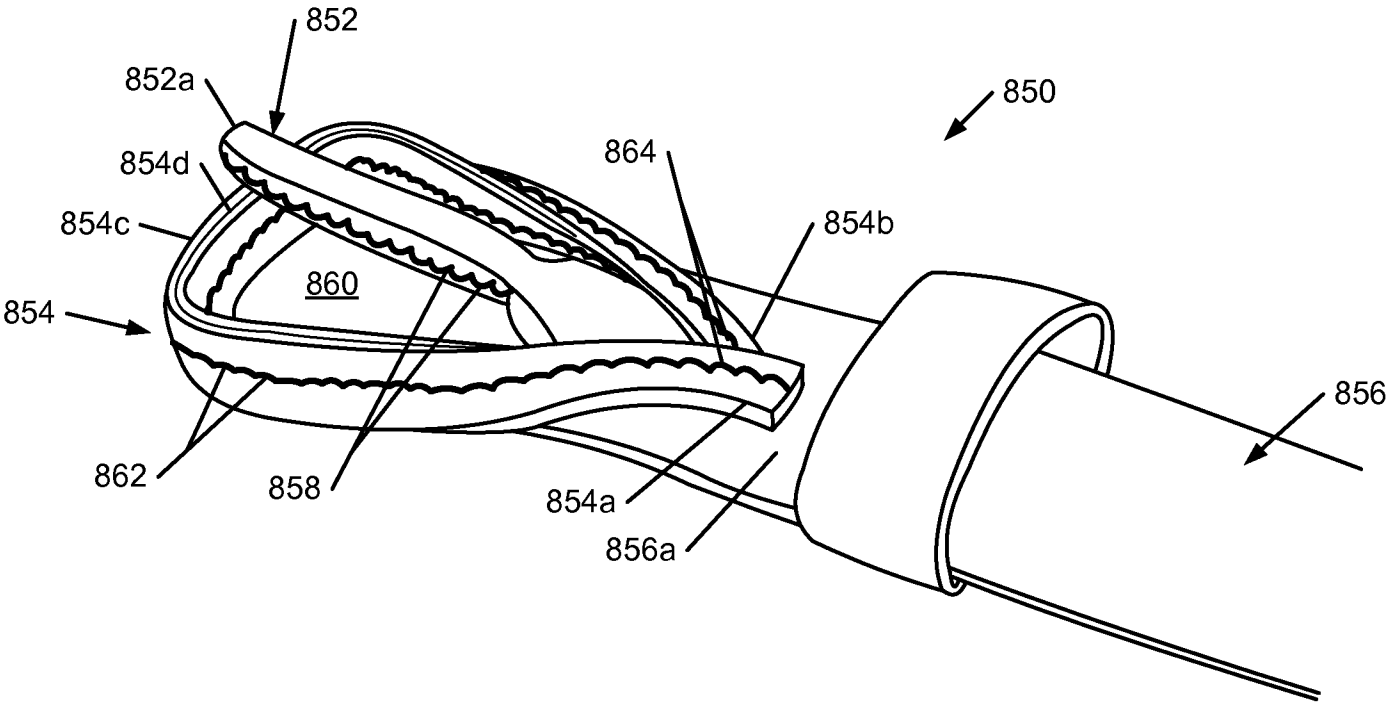
FIG. 6 illustrates another example strap and buckle assembly structure in accordance with this invention.

FIG. 6 illustrates another example strap and buckle assembly 850 in accordance with this invention. In this example structure 850, the tongue portion 852 and the buckle portion 854 are formed of flexible materials like those described above, such as the flexible material that makes up the strap structure 856 (e.g., leather, synthetic leather, plastics, etc.). The tongue portion 852 extends from the end of the strap structure 856. The buckle portion 854 is formed from an elongated generally rectangular strip of material having its end portions 854*a* and 854*b* lying flat on the surface 856*a* of the strap structure 856. The strip material of the buckle portion 854 is twisted at least twice (e.g., by 90°) such that its central portion 854*c* stands upright to provide a strip edge 854*d* as the surface that the free end 852*a* of the tongue portion 852 engages in use (e.g., once extended through a tongue receiving opening of a strap member 856). While an overlapping joint attaching both end portions 854*a* and 854*b* to the strap structure 856 is shown in FIG. 6, if desired, the end portions 854*a* and 854*b* may be separately attached to the surface of the strap structure 856 at separated locations. Any type of structure for engaging the buckle portion 854 to the strap structure 856 may be used without departing from this invention, including sewn stitches, mechanical connectors, adhesives, etc.

In this illustrated example structure 850, at least some portion of the tongue portion 852 (such as its free end) is reinforced (or strengthened) by doubling it over in its longitudinal direction and stitching the edges together (via stitching 858) to maintain the doubled over construction. Similarly, if desired, at least some portion of the buckle portion 854 (such as the portion that defines the tongue receiving opening 860) may be reinforced (or strengthened) by doubling it over and stitching the edges together (via stitching 862). If necessary, the material of the tongue portion 852 or the buckle portion 854 may be cut near the location where the doubling over structure begins (e.g., relief cuts that extend a portion of the width direction of the tongue portion 852 or the buckle portion 854), to assist in folding the material to create the folded or doubled over structure. Other reinforcing constructions or elements, like those described above, also may be used without departing from this invention. Alternatively, if desired, either or both of the tongue portion 852 and/or the buckle portion 854 could be made from a sufficiently thick and/or stiff material that such doubling over (or other reinforcing) is not necessary.

The buckle and strap assembly 850 of FIG. 6 shows the tongue portion 852 integrally formed with the strap element 856 as a unitary, one piece construction and the buckle portion 854 as a separate part attached to the strap element 856 via stitching 864. Many variations in these structures, however, are possible without departing from this invention. For example, if desired, both the tongue portion 852 and the buckle portion 854 may be made as separate parts that are attached to the strap element 856 (or to another base support member, such as a shoe, container, etc., as will be described in more detail below). As another example, if desired, both the tongue portion 852 and the buckle portion 854 may be integrally formed with the strap element 856 (or to another base support member, such as a shoe, container, etc., as will be described in more detail below) as a unitary, one piece construction. As still another example, if desired, when the buckle portion 854 includes a two layered construction, one layer may be integrally formed with the strap element 856 and the other layer (in one or more separate pieces) may be separately attached (e.g., overlaid) on the integrally formed layer.

The buckle and strap assembly 850 shown in FIG. 6 may be cut from a compact or tessellated layout to thereby produce little waste material, e.g., in the manners described above. Moreover, the buckle and strap assembly 850 may be used as a belt type structure (e.g., as shown in FIGS. 4A through 5H) or as a separate buckle-tongue member and strap member (e.g., as shown in FIGS. 1A through 1I described above and in FIGS. 8 and 9 described below).

Figure 7A:
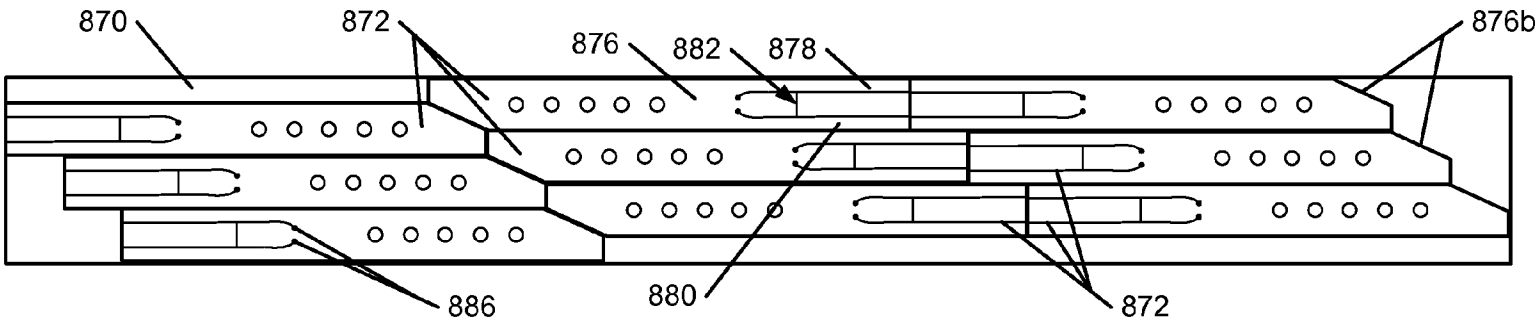
FIGS. 7A through 7D illustrate another example strap and buckle assembly structure in accordance with this invention.

FIGS. 7A through 7D illustrate potential features and characteristics of additional example buckle-tongue assemblies and buckle-strap assemblies in accordance with this invention. First, FIG. 7A illustrates a blank material 870 that includes several buckle and strap assemblies 872 in a compact or tessellated layout. With this tessellated or compact layout, there is little waste associated with the formation of numerous buckle and strap assemblies 872 (e.g., the only "wasted" material in this example layout constitutes the material cut out for the stitch or fold line holes (if any), the material cut out for the tongue-receiving openings, and/or the material located at an extreme edge portion of the overall material blank 870). In accordance with at least some examples of this invention, the overall waste material produced in making buckle and strap assemblies 872 will constitute less than 10% of an overall surface area of the material from which the buckle and strap assemblies 872 are cut, and in some examples, the amount of waste will be less than 5% of the overall surface area, or even less than 2% or 1% of the overall surface area.

One skilled in the relevant art, given the benefit of this disclosure, will recognize that the compact layout depicted in FIG. 7A is only an example of a way to design a layout for the buckle and strap assemblies 872, and that, depending on the design and shape of the buckle and strap assemblies 872, numerous other layouts could be utilized in order to create a low or minimal waste arrangement.

Figure 7B:
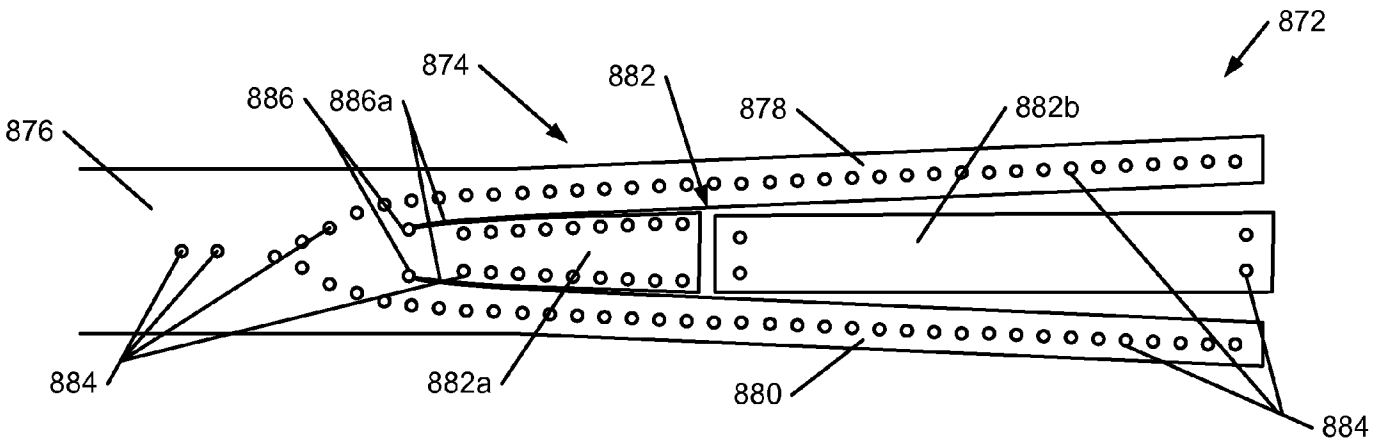

FIG. 7B provides a more detailed view of the buckle portion 874 of an individual buckle and strap assembly 872 in its cutout form (i.e., before formation of the various parts). When formed, one free end of the base substrate 876 is cut to include a first strip member 878 at one edge, a second strip member 880 at its opposite edge, and a third strip member 882 located between the edge strip members 878 and 880. Furthermore, this third strip member 882 may be cut to thereby form an integral tongue portion 882*a* and a separated loop element portion 882*b*. Additionally, if desired, stitch holes 884 may be provided at the various desired locations of the buckle and strap assembly 872, to facilitate the assembly process described in more detail below. The various cutting steps may take place in any desired manner without departing from this invention, including the various manners described above.

Figure 7C:
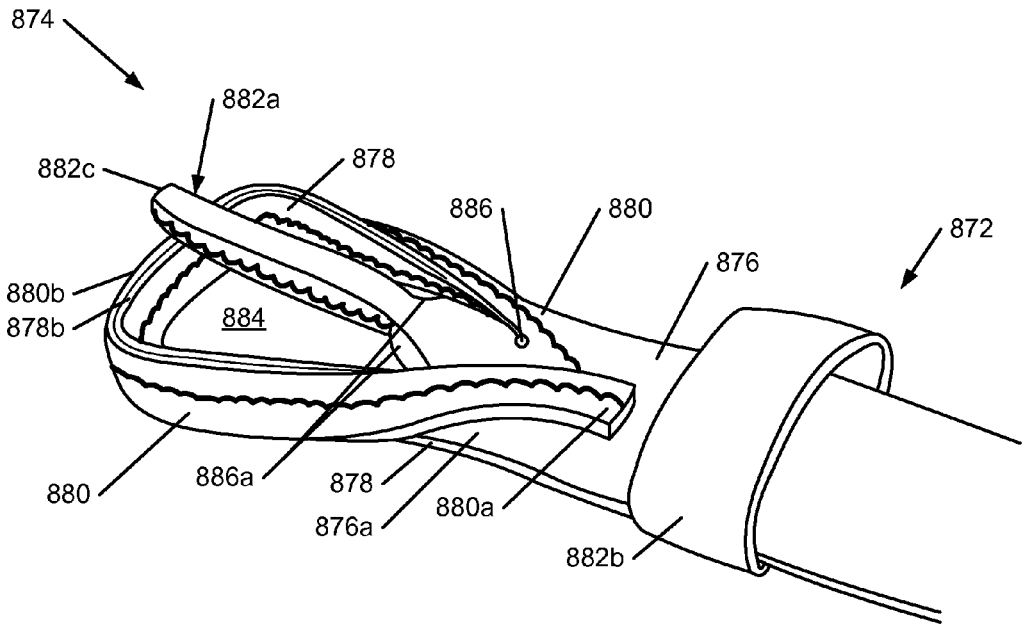

FIG. 7C provides a more detailed view of the buckle-tongue assembly portion 874 of the overall buckle and strap assembly 872. Once the buckle and strap assembly 872 is cut into the form shown in FIG. 7B, the buckle element can be formed. This may be accomplished, according to this example of the invention, by wrapping the edge strip members 878 and 880 around the structure such that their free ends engage the opposite sides of the base substrate 876. More specifically, as shown in FIG. 7C, the free end 880*a* of strip member 880 is wrapped around and attached to the top surface 876*a* of the base substrate 876. Likewise, the free end of strip member 878 is wrapped around and attached to the bottom surface (876*b*, see FIG. 7D) of the base substrate 876 in a similar manner. The two strip members 878 and 880 are attached to the base substrate 876 so as to form a strap receiving opening 884, and each strip member 878 and 880 is twisted at least 90° so as to expose an edge 878*b* and 880*b* at a location proximate to the position of the free end 882*c* of the tongue portion 882*a*. The two strip members 878 and 880 may be engaged with one another over their lengths as shown in FIG. 7C (e.g., by stitching) to provide a composite and reinforced buckle structure 874. At some locations, the two strip members 878 and 880 may be engaged together with the base substrate located between them. One strip member forms the exterior of the buckle structure 874 and the other strip member forms the interior of the buckle structure 874. The underside of the structure of FIG. 7C looks similar to FIG. 7C, with one exposed strap free end (of strip member 878 in this example) attached to the underside base surface of substrate 876.

The tongue portion 882*a* in this example structure also is integrally formed with the base substrate 876 and extends between the strip members 878 and 880 such that its free end 882*c* reaches the exposed edges 878*b* and 880*c*. As further shown in FIG. 7C, the tongue portion 882*a* may be folded or doubled over (and held in this construction in any desired manner, such as by stitching) to provide a strong tongue portion 882*a*. Relief cuts 886 may be provided near the location where the tongue portion 882*a* extends from the base substrate 876, to allow better folding of the tongue portion 882*a*. The ends of cut edges 886*a* also may be tapered, curved, or slanted inwardly somewhat, as shown in FIG. 7B, to help provide the folded or doubled over construction. FIG. 7C further illustrates the loop element 882*b* engaged with the base substrate 876, which may be accomplished in any desired manner, such as by sewing or stitching.

Figure 7D:
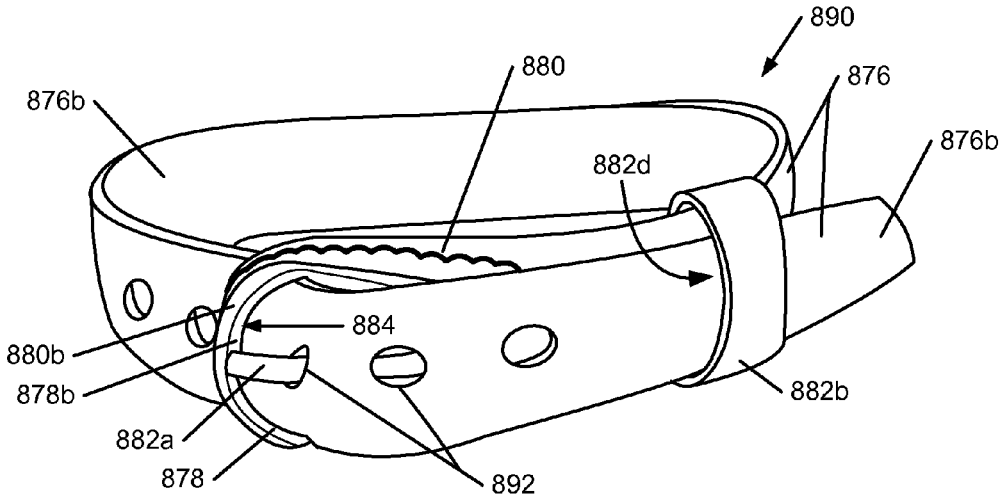

FIG. 7D illustrates an example belt structure 890 including the strap and buckle assembly 872 of FIGS. 7A through 7C in an engaged orientation. As shown, in this example structure 890, the base substrate 876 constitutes a strap member that extends around and through the opening 884 defined by the strip members 878 and 880. A plurality of tongue-receiving openings 892 are provided in the base substrate 876, and the tongue portion 882*a* extends through and engages one of these openings 892. When outward pressure is applied to the strap member 876, the tongue portion 882*a* engages the edges 878*b* and/or 880*b* of the buckle strips 878 and 880, respectively, as well as the interior of the tongue-receiving opening 892 in which it is engaged to hold the strap member 876 in place. The free end 876*b* of the strap member 876 extends through the slot 882*d* defined between the loop element 882*b* and the base substrate 876.

FIG. 7A illustrates that the free end 876*b* of the strap member 876 has a reduced width as compared to the width of the majority of the strap member 876. This reduced width can help in inserting the free end 876*b* through the opening 884 defined by the strip members 878 and 880 in the final buckle-tongue assembly 874. The reduced width can be provided in any desired manner without departing from this invention. The illustrated example shows a single tapered edge at the free end 876*b*, although, if desired, both edges may be tapered, one or both edges may be stepped downward in thickness, a combination of stepped and tapered edges may be provided, or other desired structures may be provided.

While shown as a buckle and strap assembly in FIGS. 7A through 7D, the buckle-tongue assembly of these figures also may be used as a closure or securing member for articles (e.g., as a separate buckle-tongue member and strap member, such as shown in FIGS. 1A through 11 described above and in FIGS. 8 and 9 described below). The two part structure may be provided, if desired, by cutting the strap member 876 and separately attaching these two parts to a container or other element to be closed or secured.

While the example of FIGS. 7A through 7D shows the buckle strip portions 878 and 880 and tongue portion 882*a* integrally formed with the base substrate 876 as a unitary, one piece construction, if desired in accordance with at least some examples of this invention, any, all, or any combination of these components may be separately formed and/or attached to the base substrate 876. For example, the tongue portion 882*a* may be separately formed and attached, or either or both of the strip portions 878 and 880 may be separately formed and attached. The attachment mechanisms may include, for example, sewing or stitching, mechanical connectors, cements or adhesives, etc.

Figure 8:
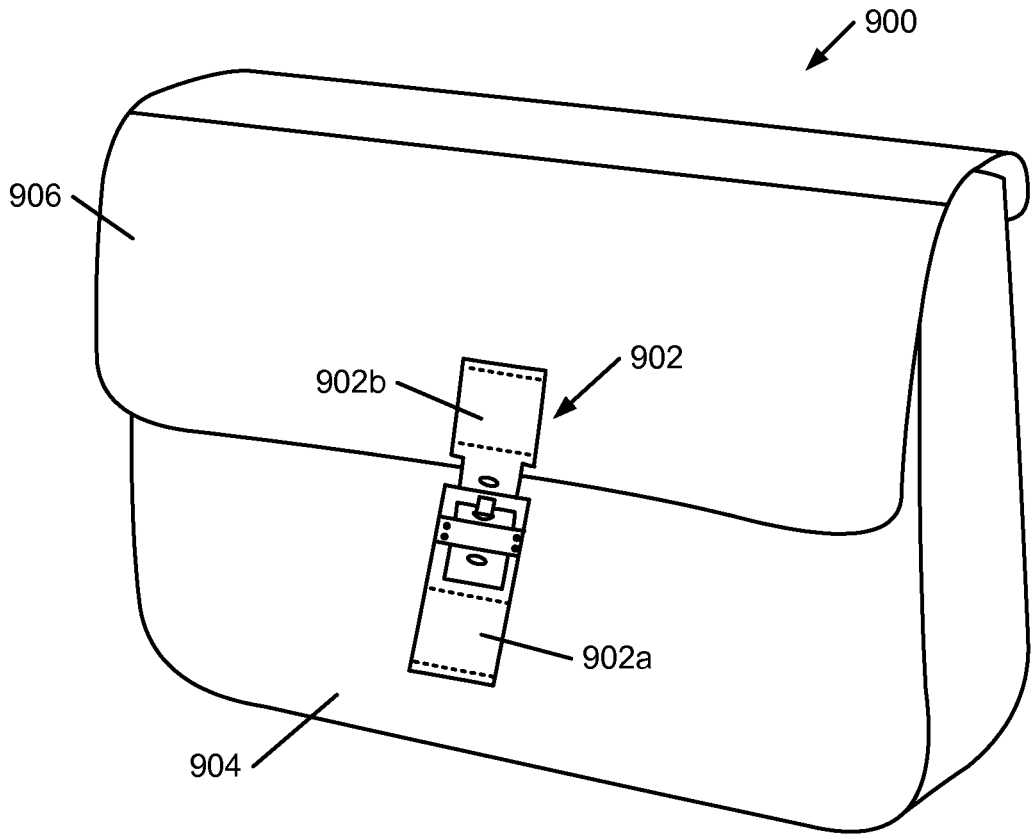
FIG. 8 illustrates an example container type device that may include a strap and buckle assembly according to examples of this invention.

6. Example Products Including Strap and Buckle Assemblies According to this Invention Strap and buckle assemblies in accordance with examples of this invention may be used on a wide variety of products without departing from this invention, including, for example, belts or straps having the buckle portion integrally connected to the free end portion (including the tongue receiving openings), such as structures 700 and 800 described above. Additionally, structures in accordance with this invention may be used as a two part closure or securing system, wherein the buckle member is engaged with one part of the closure or securing system (such as a base member) and the strap member is engaged with another part of the closure or securing system (such as a closure flap). FIG. 8 illustrates one example of such a structure 900. FIG. 8 illustrates a carrying case type device 900 (such as a briefcase, purse, backpack, or the like) in which the buckle portion 902*a* of the closure system 902 is engaged with the bag base 904 and the strap portion 902*b* of the closure system is engaged with a cover flap 906. If desired, the closure system 902 may be inverted such that the buckle portion 902*a* of the closure system 902 is engaged with the cover flap 906 and the strap portion 902*b* of the closure system 902 is engaged with bag base 904. The closure system 902 may be engaged with the bag base 904 and the cover flap 906 in any desired manner without departing from this invention, including through the use of sewing or stitching; by cements or adhesives; by staples, rivets or other mechanical connectors; by interlocking or other retaining element structures; etc.

The carrying case 900 may be of any desired size, shape, and dimensions, etc., without departing from this invention, and it may be used for carrying any desired items. Also, if desired, the closure system 902 may be of the types illustrated in FIGS. 5A through 5H, FIG. 6, and FIGS. 7A through 7D.

Figure 9:
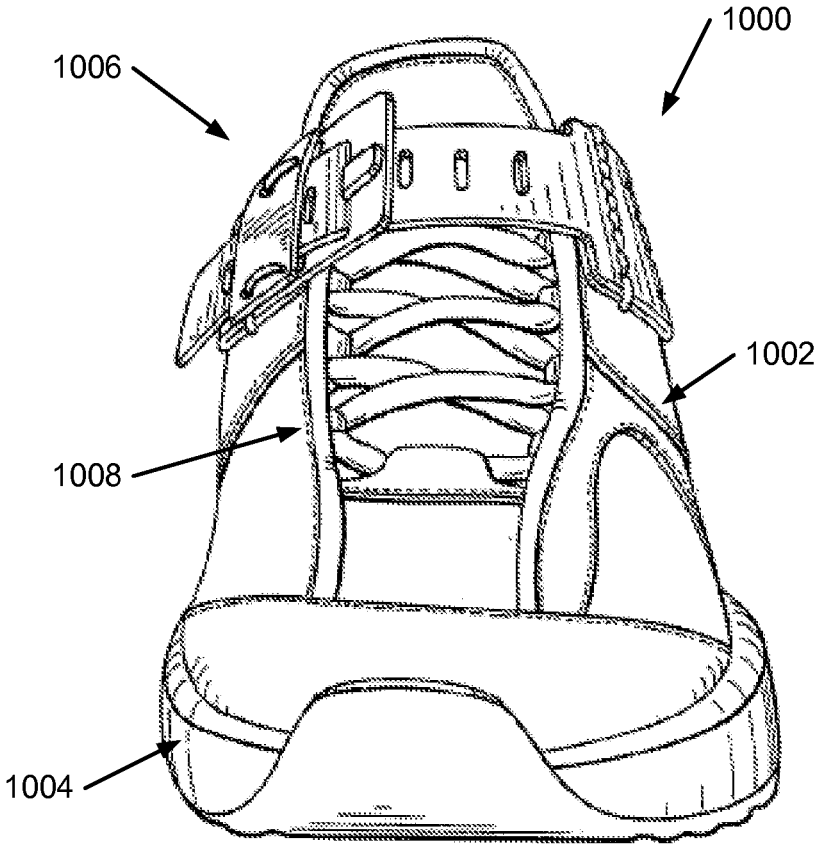
FIG. 9 illustrates an example article of footwear that may include a strap and buckle assembly according to examples of this invention.

Strap and buckle assemblies in accordance with examples of this invention further may be used as closure or securing systems for footwear or other articles of clothing (such as coats, jackets, pants, shirts, etc.). FIG. 9 illustrates an article of footwear 1000 (including an upper member 1002 and a sole structure 1004) that includes a strap and buckle assembly 1006 according to one example of this invention as part of the closure system that helps retain the wearer's foot in the shoe 1000. While it may be the sole or primary closure system for the article of footwear or other article of clothing, in this illustrated example, the strap and buckle assembly 1006 is a secondary closure system provided in addition to a conventional shoe lace type closure system 1008. Additionally or alternatively, the strap and buckle assembly 1006 may extend around the ankle opening in the article of footwear 1000 to help support the ankle and keep the shoe on the foot. If desired, the strap and buckle assembly 1006 may be of the types illustrated in FIGS. 5A through 5H FIG. 6, and FIGS. 7A through 7D.

An article of athletic footwear is illustrated in FIG. 9, such as a running shoe. Those skilled in the art, given the benefit of this disclosure, will recognize that aspects of this invention may be practiced on any desired type of athletic footwear, including, for example, baseball shoes, basketball shoes, cross-training shoes, cycling shoes, football shoes, tennis shoes, soccer shoes, walking shoes, golf shoes, and hiking boots. Features of this invention also may be applied to footwear styles that are generally considered to be non-athletic, including dress shoes, loafers, sandals, and work boots.

C. Conclusion

The above disclosure generally describes strap and buckle assemblies that may be used in footwear, articles of clothing, or containers that are generally relatively portable, such as purses, backpacks, briefcases, electronics cases, books, etc. This is not a requirement. Rather, if desired, aspects of this invention may be utilized on heavier and/or more permanently stationed objects, such as large chests; drawers; cabinet doors; other doors; storage spaces on boats, motor homes, motorcycles, bicycles, or other vehicles; etc.

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

I claim:

1. A strap and buckle assembly, comprising:

a buckle-tongue piece including a buckle piece that has an opening defined therethrough and a tongue piece engaged with the buckle piece, wherein the tongue piece has the same perimeter shape as the opening and is formed from a material cut out of the buckle piece to form the opening, and further wherein the tongue piece overlaps the opening in the buckle piece; and a strap having at least a first tongue receiving opening defined therein, wherein during the engagement of the strap and buckle assembly, the tongue piece engages the first tongue receiving opening to press the strap against the buckle piece.

2. A strap and buckle assembly according to claim 1, further comprising:

a loop element engaged with the buckle piece or the strap to thereby define a slot, wherein during the engagement of the strap and buckle assembly, a free end of the strap extends into or through the slot.

3. A strap and buckle assembly according to claim 1, wherein the tongue piece is T-shaped and the opening in the buckle piece is T-shaped.

4. A strap and buckle assembly according to claim 1, wherein the tongue piece includes a base portion and an extending portion, wherein the base portion is wider than the extending portion.

5. A strap and buckle assembly according to claim 1, wherein the tongue piece includes a base portion and an extending portion, wherein the base portion is wider than the extending portion, wherein the opening in the buckle piece includes a base opening portion and an extending opening portion, and wherein the base opening portion is wider than the extending opening portion.

6. A strap and buckle assembly according to claim 5, wherein the tongue piece is arranged such that its base portion extends across the extending opening portion of the buckle piece and such that the extending portion of the tongue piece extends across the base opening portion of the buckle piece.

7. A strap and buckle assembly according to claim 1, wherein during the engagement of the strap and buckle assembly, the strap engages with the buckle piece at an edge of the buckle piece opposite a location of the opening in the buckle piece.

8. A strap and buckle assembly according to claim 1, wherein the strap extends from and is integrally formed with the buckle piece as a unitary, one piece construction.

9. A strap and buckle assembly according to claim 1, wherein the opening and the tongue piece have the same perimeter shape.

10. An article of footwear, comprising:

an upper member;

a sole structure engaged with the upper member; and a securing system engaged with the upper member for securing the article of footwear to a wearer's foot, wherein the securing system includes a strap and buckle assembly according to claim 1.

* * * * *